US007717568B2

(12) United States Patent
Fujimori et al.

(10) Patent No.: US 7,717,568 B2
(45) Date of Patent: May 18, 2010

(54) MANUFACTURING METHOD FOR COOLING UNIT, COOLING UNIT, OPTICAL DEVICE, AND PROJECTOR

(75) Inventors: Motoyuki Fujimori, Suwa (JP); Satoshi Kinoshita, Matsumoto (JP); Makoto Zakoji, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1121 days.

(21) Appl. No.: 11/359,515

(22) Filed: Feb. 23, 2006

(65) Prior Publication Data

US 2006/0196050 A1 Sep. 7, 2006

(30) Foreign Application Priority Data

Mar. 1, 2005 (JP) ..... 2005-055631
Dec. 5, 2005 (JP) ..... 2005-350449

(51) Int. Cl.
*G03B 21/18* (2006.01)
*B21D 53/06* (2006.01)

(52) U.S. Cl. ..... 353/54; 353/61; 29/890.035; 29/890.045

(58) Field of Classification Search ..... 353/61, 353/54; 29/890.035, 890.045
See application file for complete search history.

(56) References Cited

U.S. PATENT DOCUMENTS 5,829,516 A 11/1998 Lavochkin
2006/0197919 A1 9/2006 Fujimori et al.
2006/0198150 A1 9/2006 Kinoshita et al.
2007/0051057 A1 * 3/2007 Zakoji et al. ..... 52/171.3

FOREIGN PATENT DOCUMENTS

| | | |
|---|---|---|
| CN | 1204394 A | 1/1999 |
| JP | A-60-294 | 1/1985 |
| JP | A-9-96787 | 4/1997 |
| JP | A 2002-156195 | 5/2002 |
| JP | A-2003-262917 | 9/2003 |
| JP | A-2003-337219 | 11/2003 |
| JP | A-2006-242414 | 9/2006 |
| JP | A-2006-242415 | 9/2006 |
| JP | A-2006-243123 | 9/2006 |

* cited by examiner

*Primary Examiner*—William C Dowling
*Assistant Examiner*—Magda Cruz
(74) *Attorney, Agent, or Firm*—Oliff & Berridge, PLC

(57) ABSTRACT

A manufacturing method for a cooling unit that includes a cooling plate in which a cooling fluid flows, the cooling plate having a cooling pipe through which the cooling fluid flows, and a pair of tabular members arranged to be opposed to each other across the cooling pipe, the manufacturing method for a cooling unit includes: forming a groove in which the cooling pipe is housed at least in one opposed surface of the pair of tabular members; combining the pair of tabular members while housing the cooling pipe in the groove; and filling a heat conduction material in a gap between the groove and the cooling pipe.

9 Claims, 23 Drawing Sheets

B–B

C-C

MANUFACTURING METHOD FOR COOLING UNIT, COOLING UNIT, OPTICAL DEVICE, AND PROJECTOR

BACKGROUND

1. Technical Field

The present invention relates to a manufacturing method for a cooling unit, a cooling unit, an optical device, and a projector.

2. Related Art

As a cooling unit using a cooling fluid, there is one including a cooling plate in which a metal pipe serving as a cooling fluid channel is arranged between inner surfaces of a pair of metal plates combined to be opposed to each other. This cooling plate is manufactured by forming a pipe housing groove larger than the metal pipe at least in one of the pair of metal plates and integrally combining the metal pipe and the pair of metal plates. In a manufacturing process of the cooling plate, a pressurized fluid is supplied into the metal pipe after the combination and the metal pipe is expanded in diameter to cause the metal pipe to come into close contact with the pipe housing groove (see, for example, JP-A-2002-156195).

In the manufacturing method for a cooling unit, the pipe housing groove is formed in a reverse taper shape with respect to a mating surface of the metal plate and the metal plate and the metal pipe are combined by causing an edge portion (an undercut portion) of the groove to cut into the metal pipe at the time of the expansion of the diameter of the metal pipe.

However, in the manufacturing method, cutting needs to be performed using a special cutting tool for formation of the undercut portion. Thus, it is difficult to realize a reduction in cost.

In order to satisfactorily bring the metal pipe into close contact with the pipe housing groove, it is necessary to repeat the processing for expanding the diameter of the metal pipe plural times. This requires a great deal of time.

Moreover, when the metal pipe has a small diameter, it is difficult to expand the diameter of the metal pipe and an amount of deformation of the metal pipe tends to fluctuate. Thus, a gap is formed between the metal pipe and the pipe housing groove. As a result, deterioration in cooling performance of the cooling plate tends to be causes.

SUMMARY

An advantage of some aspects of the invention is to provide a manufacturing method for a cooling unit, a cooling unit, an optical device, and a projector that are suitable for a reduction in cost and a reduction in size.

A manufacturing method according to a first aspect of the invention is a method of manufacturing a cooling unit that includes a cooling plate in which a cooling fluid flows. The cooling plate has a cooling pipe through which the cooling fluid flows, and a pair of tabular members arranged to be opposed to each other across the cooling pipe. The manufacturing method includes: forming a groove in which the cooling pipe is housed at least in one opposed surface of the pair of tabular members; combining the pair of tabular members while housing the cooling pipe in the groove; and filling a heat conduction material in a gap between the groove and the cooling pipe.

In a cooling unit manufactured by the manufacturing method according to the first aspect of the invention, the tabular members and the cooling pipe are thermally connected directly in a portion where the groove of the tabular members and the cooling pipe are in contact with each other.

The tabular members and the cooling pipe are thermally connected indirectly via the heat conduction material in a portion where the gap is formed.

In other words, in the manufacturing method according to the first aspect of the invention, it is possible to thermally connect the tabular members and the cooling pipe without expanding a diameter of the cooling pipe. Since a process for expanding the diameter of the cooling pipe is made unnecessary, it is possible to significantly reduce a manufacturing time. The manufacturing method according to the first aspect of the invention is preferably applied to a small-diameter cooling pipe as well. Therefore, the manufacturing method according to the first aspect of the invention is preferably applied to a reduction in cost and a reduction in size.

In the cooling unit manufactured by the manufacturing method according to the first aspect of the invention, since the groove of the tabular members and the cooling pipe are thermally connected, heat of an object to be cooled, which comes into contact with the tabular members, is removed by the cooling fluid flowing through the cooling pipe. In the structure in which the cooling pipe is disposed in the cooling plate, a risk of fluid leakage is low because only a relatively small joining portion is required for forming a channel for the cooling fluid. Further, a piping resistance is low because the channel, which is uniform and smooth in a flowing direction of the fluid, is formed.

A thermal conductivity of the heat conduction material is preferably equal to or higher than 3 W/(m·K) and more preferably equal to or higher than 5 W/(m·K). The thermal conductivity of the heat conduction material lower than 3 W/(m·K) is not preferable because heat of the tabular members less easily moves to the cooling pipe. When the thermal conductivity of the heat conduction material is equal to or higher than 5 W/(m·K), heat of the tabular members satisfactorily moves to the cooling pipe.

It is possible that, for example, in the manufacturing method according to the first aspect of the invention the heat conduction material includes at least one of a resin material mixed with a metal material, a resin material mixed with a carbon material, and hot-melt adhesive.

In this case, it is preferable that the heat conduction material has elasticity in an operating temperature range of the cooling plate.

Since the heat conduction material has elasticity, the heat conduction material expands and contracts according to a change of the gap between the tabular members and the cooling pipe involved in thermal deformation or the like. Thus, thermal connection between the tabular members and the cooling pipe are stably maintained.

It is possible that, in forming the groove, the groove is formed using a casting method or a forging method. In the casting method or the forging method, a reduction in cost is easily realized through mass production compared with the formation of the groove using the cutting.

It is possible that, in forming the groove, a supplementary groove, in which the heat conduction material is at least temporarily stored, is further formed in the inner surface of the groove and/or in at least the one opposed surface of the pair of tabular members.

With the supplementary groove, an amount of arrangement of the heat conduction material is appropriately adjusted according to a capacity of the gap between the tabular members and the cooling pipe and the thermal connection between the tabular members and the cooling pipe is stably maintained.

It is possible that, in filling the heat conduction material, the heat conduction material is softened and fluidized to be filled.

In this case, for example, the heat conduction material is softened by the heating by an object that holds the pair of tabular members and/or the flow of a high-temperature fluid in the cooling pipe.

Since the heat conduction material is softened and fluidized, the heat conduction material is filled in the entire area of the gap.

It is possible that, in combining the pair of tabular members, at least one of fastening by screws or the like, bonding, welding, and mechanical combination such as fitting is used.

It is possible to combine the pair of tabular members with each other by using such methods.

It is possible that at least a part of a combining force of the pair of tabular members is obtained by an adhesive force of the heat conduction material.

A manufacturing method according to a second aspect of the invention is a method of manufacturing a cooling unit including a cooling plate in which a cooling fluid flows. The cooling plate has a cooling pipe through which the cooling fluid flows, and a pair of tabular members arranged to be opposed to each other across the cooling pipe. The manufacturing method according to the second aspect of the invention includes forming a second tabular member around the cooling pipe according to molding using a material having a low melting point compared with that of the cooling pipe in a state in which the cooling pipe is arranged on a first tabular member of the pair of tabular members.

In the manufacturing method according to the second aspect of the invention, the second tabular member is formed around the cooling pipe according to molding. Consequently, the second tabular member and the cooling pipe are brought into close contact with each other and thermally connected to each other. Since the second tabular member is formed according to an external shape of the cooling pipe, the tabular members and the cooling pipe satisfactorily come into contact with each other and a heat transfer property between the second tabular member and the cooling pipe is improved. Thus, the manufacturing method according to the second aspect of the invention is preferably applied to a small-diameter cooling pipe as well.

Therefore, the manufacturing method according to the second aspect of the invention is preferably applied to a reduction in cost and a reduction in size.

In this case, for example, it is possible to thermally connect the respective tabular members and the cooling pipe by combining the first tabular member and the second tabular member following the molding of the second tabular member.

In the cooling unit manufactured by the manufacturing method according to the second aspect of the invention, as in the manufacturing method according to the first aspect of the invention, the tabular members and the cooling pipe are thermally connected and heat of an object to be cooled that comes into contact with the tabular members is removed by the cooling fluid flowing through the cooling pipe. In the structure in which the cooling pipe is disposed in the cooling plate, a risk of fluid leakage is low because only a relatively small joining portion is required for forming a channel for the cooling fluid. Further, a piping resistance is low because the channel, which is uniform and smooth in a flowing direction of the fluid, is formed.

It is preferable that, for example, in the manufacturing method according to the second aspect of the invention the first tabular member is formed of a metal material or a resin material and the second tabular member is formed of a resin material.

It is possible that, for example, the resin material includes at least one of a resin material mixed with a metal material and a resin material mixed with a carbon material.

In this case, it is preferable that a coefficient of thermal expansion of the cooling pipe and a coefficient of thermal expansion of each of the pair of the tabular members are substantially the same.

Consequently, since at least one of the tabular members is formed of a resin material having a high thermal conductivity, a reduction in weight of the cooling unit is realized. Since a coefficient of thermal expansion of the cooling pipe and a coefficient of thermal expansion of each of the tabular members are substantially the same, at the time of hardening and contraction or after molding, a gap due to a difference of an amount of thermal deformation is prevented from being formed between the respective tabular members and the cooling pipe. Thermal connection between the respective tabular members and the cooling pipe is stably maintained.

It is possible that the manufacturing method according to the second aspect of the invention further includes filling a heat conduction material in a gap between the cooling pipe and at least one of the pair of tabular members.

Consequently, a heat transfer property between the tabular members and the cooling pipe is improved by filling the heat conduction material.

Thermal conductivity of the heat conduction material is preferably equal to or higher than 3 W/(m·K) and more preferably equal to or higher than 5 W/(m·K). The thermal conductivity of the heat conduction material lower than 3 W/(m·K) is not preferable because heat of the tabular members less easily moves to the cooling pipe. When the thermal conductivity of the heat conduction material is equal to or higher than 5 W/(m·K), heat of the tabular members satisfactorily moves to the cooling pipe.

In this case, it is preferable that, for example, the heat conduction material includes at least one of a resin material mixed with a metal material, a resin material mixed with a carbon material, and hot-melt adhesive.

It is preferable that the heat conduction material has elasticity in an operating temperature range of the cooling plate.

Since the heat conduction material has elasticity, the heat conduction material expands and contracts according to a change of the gap between the tabular members and the cooling pipe involved in thermal deformation or the like. Thus, thermal connection between the tabular members and the cooling pipe are stably maintained.

It is preferable that a supplementary groove, which communicates with the gap and in which the heat conduction material is at least temporarily housed, is formed in the first tabular member.

With the supplementary groove, an amount of arrangement of the heat conduction material is appropriately adjusted according to a capacity of the gap between the first tabular member and the cooling pipe and the thermal connection between the first tabular member and the cooling pipe is stably maintained.

It is possible that the heat conduction material is softened and fluidized to be filled.

In this case, for example, the heat conduction material is softened by the heat at the time of molding of the second tabular member and/or the flow of a high-temperature fluid in the cooling pipe.

Since the heat conduction material is softened and fluidized, the heat conduction material is filled in the entire area of the gap.

A manufacturing method according to a third aspect of the invention is a method of manufacturing a cooling unit including a cooling plate in which a cooling fluid flows. The cooling plate has a cooling pipe through which the cooling fluid flows, and a tabular member inside which the cooling pipe is arranged. The manufacturing method according to the third aspect of the invention includes forming the tabular member around the cooling pipe according to molding using a material having a low melting point compared with that of the cooling pipe.

In the manufacturing method according to the third aspect of the invention, the tabular member is formed around the cooling pipe according to molding. Consequently, the tabular member and the cooling pipe are brought into close contact with each other and thermally connected to each other. Since the tabular member is formed according to an external shape of the cooling pipe, the tabular member and the cooling pipe satisfactorily come into contact with each other and a heat transfer property between the tabular member and the cooling pipe is improved. Thus, the manufacturing method according to the third aspect of the invention is preferably applied to a small-diameter cooling pipe as well.

Therefore, the manufacturing method according to the third aspect of the invention is preferably applied to a reduction in cost and a reduction in size.

In the cooling unit manufactured by the manufacturing method according to the third aspect of the invention, as in the manufacturing method according to the first aspect of the invention, the tabular member and the cooling pipe are thermally connected and heat of an object to be cooled that comes into contact with the tabular member is removed by the cooling fluid flowing through the cooling pipe. In the structure in which the cooling pipe is disposed in the cooling plate, a risk of fluid leakage is low because only a relatively small joining portion is required for forming a channel for the cooling fluid. Further, a piping resistance is low because the channel, which is uniform and smooth in a flowing direction of the fluid, is formed.

It is preferable that, for example, both the cooling pipe and the tabular member are formed of a metal material.

In this case, it is preferable that a coefficient of thermal expansion of the tabular member is high compared with that of the cooling pipe.

For example, it is possible that the cooling pipe is formed of a copper alloy and the tabular member is formed of an aluminum alloy or a magnesium alloy.

Since a coefficient of thermal expansion of the tabular member is large compared with that of the cooling pipe, an amount of contraction of the tabular member is large compared with that of the cooling pipe at the time of hardening and contraction of the tabular member. Thus, a gap is prevented from being formed between the tabular member and the cooling pipe and thermal connection between the tabular member and the cooling pipe is stably maintained.

It is preferable that, for example, in the manufacturing method according to the third aspect of the invention the cooling pipe is formed of a metal material and the tabular member is formed of a resin material having a high thermal conductivity.

In this case, it is preferable that a coefficient of thermal expansion of the cooling pipe and a coefficient of thermal expansion of the tabular member are substantially the same.

It is possible that, for example, the resin material includes at least one of a resin material mixed with a metal material and a resin material mixed with a carbon material.

Since the tabular member is formed of a resin material having a high thermal conductivity, a reduction in weight of the cooling unit is realized. Further, since a coefficient of thermal expansion of the cooling pipe and a coefficient of thermal expansion of the tabular member are substantially the same, a gap is prevented from being formed between the tabular member and the cooling pipe after molding. Thermal connection between the tabular member and the cooling pipe is stably maintained.

A cooling unit according to a fourth aspect of the invention is manufactured by the manufacturing method for a cooling unit according to any one of the first to the third aspects of the invention.

According to the cooling unit, a reduction in cost and a reduction in weight are realized.

An optical device according to a fifth aspect of the invention is an optical device including optical modulators that modulate light beams emitted from a light source according to image information to form an optical image. At least the optical modulators are mounted on a cooling unit that is manufactured by the manufacturing method according to any one of the first to the third aspects of the invention.

According to the optical device, a reduction in cost, a reduction in size, and efficiency of cooling are realized.

A projector according to a sixth aspect of the invention includes: a light source device; an optical device in which at least optical modulators that modulate light beams emitted from the light source device according to image information to form an optical image are mounted on a cooling unit manufactured by the manufacturing method according to any one of the first to the third aspect of the invention; and a projection optical device that magnifies and projects the optical image formed by the optical device.

According to the projector, a reduction in cost, a reduction in size, and efficiency of cooling are realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

First embodiment

A first embodiment of the invention will be hereinafter explained with reference to the accompanying drawings. In the respective figures, dimensions of components are made different from actual dimensions as required in order to set sizes of the components to be recognizable on the drawings.

First Cooling Unit

Figure 1A:
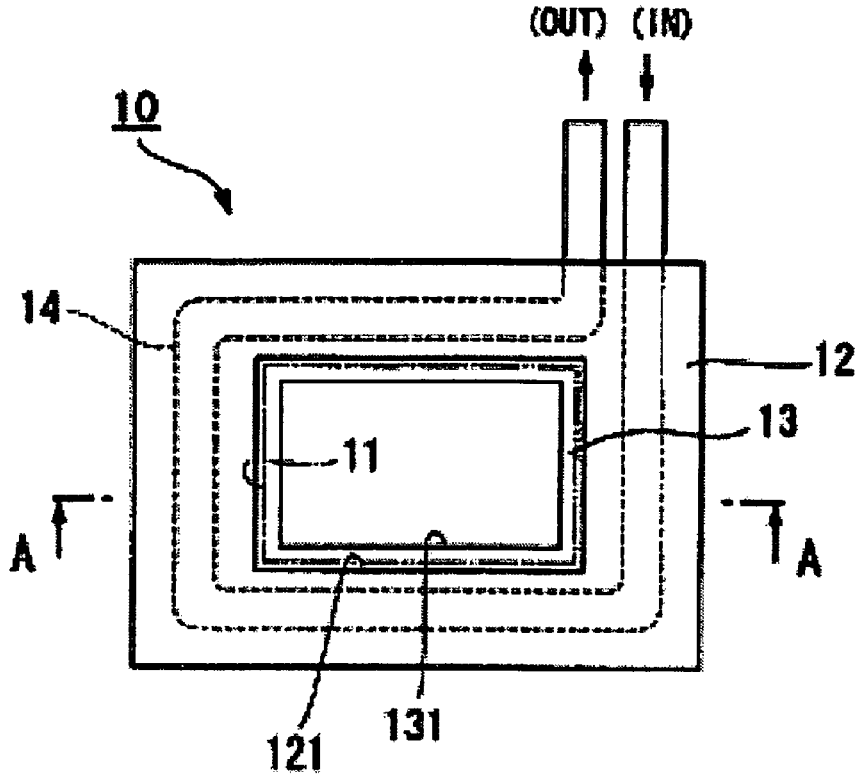
FIG. 1A is a plan view showing a constitution of a cooling unit.
Figure 1B:
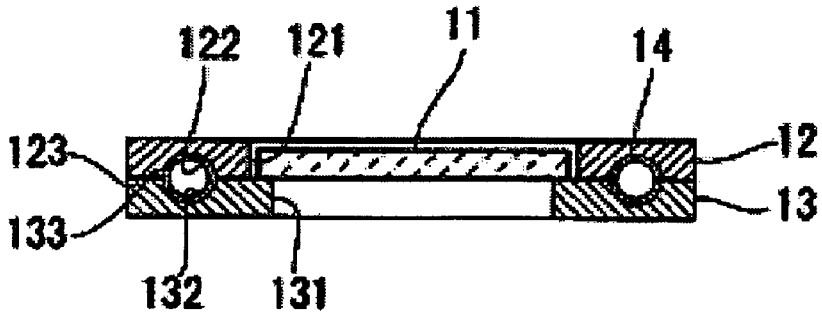
FIG. 1B is a sectional view along line A-A in FIG. 1A.

FIG. 1A is a plan view showing a constitution of a cooling unit 10. FIG. 1B is a sectional view along line A-A shown in FIG. 1A.

As shown in FIGS. 1A and 1B, the cooling unit 10 is a unit that holds a peripheral edge of a transmissive optical element 11 and cools the optical element 11. The cooling unit 10 includes a pair of tabular members 12 and 13 that holds the optical element 11 and a cooling pipe 14 that is sandwiched by the pair of tabular members 12 and 13.

As the optical element 11, other than a liquid crystal panel and a sheet polarizer, various optical elements such as a phase plate and a viewing angle compensating plate are adoptable. The invention is applicable not only to the transmissive optical element but also to a reflective optical element. Moreover, the invention is applicable to cooling of not only the optical element but also of other objects. An example in which a cooling plate of the invention is applied to a cooling structure for a liquid crystal panel and a sheet polarizer will be explained in detail later.

The tabular members 12 and 13 are frames of a rectangular shape in a plan view. The tabular members 12 and 13 have rectangular openings 121 and 131 corresponding to transmission areas for light beams in the optical element 11 and grooves 122 and 132 for housing the cooling pipe 14, respectively. The tabular members 12 and 13 are arranged to be opposed to each other across the cooling pipe 14. A thermal good conductor made of a material having a high thermal conductivity is used as the tabular members 12 and 13. For example, various kinds of metals are adopted other than aluminum, (234 W/(m·K)), magnesium (156 W/(m·K)), and alloys of aluminum and magnesium (an aluminum alloy (about 100 W/(m·K)), a low specific gravity magnesium alloy (about 50 W/(m·K)), etc.). The tabular members 12 and 13 are not limited to a metal material and may be other materials (a resin material, etc.) having a high thermal conductivity (e.g., equal to or higher than 5 W/(m·K)).

The cooling pipe 14 is made of, for example, a pipe or a tube that has an annular section and extends along a center axis of the section. The cooling pipe 14 is bent according to a geometry of the grooves 122 and 132 of the tabular members 12 and 13. As the cooling pipe 14, a thermal good conductor made of a material having a high thermal conductivity is preferably used. For example, various kinds of metal are adopted other than aluminum (234 W/(m·K)), copper (398 W/(m·K)), stainless steel (16 W/(m·K) (austenitic)), and alloys of aluminum, copper, and stainless steel. The cooling pipe 14 is not limited to a metal material and may be other materials (a resin material, etc.) having a high thermal conductivity (e.g., equal to or higher than 5 W/(m·K)).

Specifically, as shown in FIGS. 1A and 1B, the cooling pipe 14 is disposed on an outer side of the peripheral edge of the optical element 11 and along substantially the entire peripheral edge of the optical element 11. In other words, on respective opposed surfaces 123 and 133 (inner surfaces or mating surfaces) of the tabular members 12 and 13, the grooves 122 and 132 of a substantially semicircular shape in section are formed along the entire edges of the openings 121 and 131. The groove 122 and the groove 132 are in a substantially mirror symmetrical shape relation with each other. The tabular members 12 and 13 are joined with each other in a state in which the cooling pipe 14 is housed in the grooves 122 and 132. In this example, the cooling pipe 14 is a circular pipe and an outer diameter thereof is substantially the same as thickness of the optical element 11.

Figure 2:
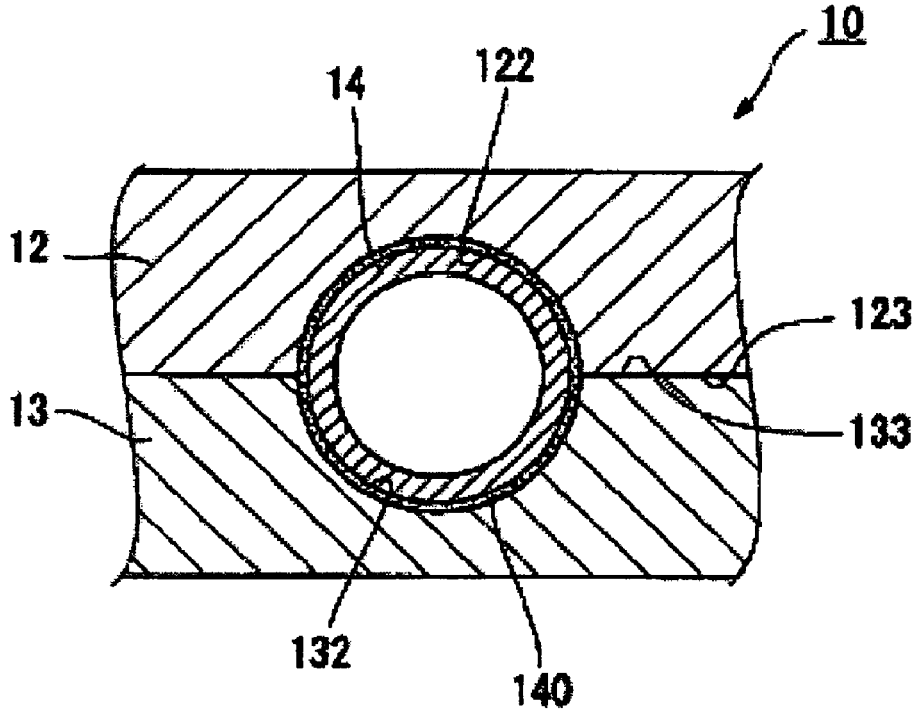
FIG. 2 is a partial sectional view showing grooves of tabular members in an enlarged state.

FIG. 2 is a partial sectional view showing the grooves 122 and 132 of the tabular members 12 and 13 in an enlarged state. As shown in FIG. 2, the grooves 122 and 132 in the respective tabular members 12 and 13 and the cooling pipe 14 have external shape portions (semicircular sectional shapes) of substantially the same shapes such that the grooves 122 and 132 and the cooling pipe 14 are combined with each other. Diameters of the grooves 122 and 132 are formed to be substantially the same as or slightly larger than the external shapes of the cooling pipe 14. For example, an inner diameter dimension of the grooves 122 and 132 are formed with a positive tolerance with respect to an outer diameter dimension of the cooling pipe 14. A heat conduction material 140 is filled in a gap between the grooves 122 and 132 and the cooling pipe 14 formed at the time of combination or the like.

As the heat conduction material 140, a thermal good conductor made of a material having a high thermal conductivity is preferably used. Specifically, for example, a resin material mixed with a metal material, a resin material mixed with a carbon material, hot-melt adhesive, or the like is used. A thermal conductivity of the heat conduction material 140 is preferably equal to or higher than 3 W/(m·K) and more preferably equal to or higher than 5 W/(m·K). A thermal conductivity of hot-melt adhesive is usually equal to or higher than 5 W/(m·K)). As the resin material mixed with a metal material or a carbon material, there is a resin material having a thermal conductivity equal to or higher than 3 W/(m·K) and a resin material having a thermal conductivity equal to or higher than 10 W/(m·K). As an example, there are D2 (registered trademark) (an LCP resin mixed with a material for heat transfer), 15 W/(m·K), coefficient of thermal expansion: 10×10^−6/k) and RS007 (registered trademark) (a PPS resin mixed with a material for heat transfer, 3.5 W/(m·K), coefficient of thermal expansion: 20×10^−6/K) manufactured by Cool Polymers, Inc.

The tabular member 12 and the tabular member 13 are combined using at least one of fastening by screws or the like, bonding, welding, and mechanical combination such as fitting. A simple combining method is used for a reduction in cost and a reduction in size. At least a part of a combining force of the tabular member 12 and the tabular member 13 may be obtained by an adhesive force of the heat conduction material 140.

Referring back to FIGS. 1A and 1B, an inflow section (IN) for a cooling fluid is disposed at one end of the cooling pipe 14 and an outflow section (OUT) is disposed at the other end thereof. The inflow section and the outflow section of the cooling pipe 14 are connected to piping for circulation of the cooling fluid, respectively. On a path of the cooling fluid, devices for fluid circulation such as a fluid pumping unit, various tanks, and a radiator, which are not shown in the figure, are arranged.

The cooling fluid flowing into the cooling pipe 14 from the inflow section (IN) flows along substantially the entire peripheral edge of the optical element 11 and flows out from the outflow section (OUT). The cooling fluid deprives the optical element 11 of heat while flowing through the cooling pipe 14. In other words, the heat of the optical element 11 is transmitted to the cooling fluid in the cooling pipe 14 via the tabular members 12 and 13 and carried to the outside.

In this example, the respective tabular members 12 and 13 and the cooling pipe 14 are thermally connected directly in a part where the grooves 122 and 132 of the tabular members 12 and 13 and the cooling pipe 14 are in direct contact with each other. The tabular members 12 and 13 and the cooling pipe 14 are thermally connected indirectly via the heat conduction material 140 in a part where a gap is formed. In other words, heat transfer between the tabular members 12 and 13 and the cooling pipe 14 is supplemented by the heat conduction material 140 to realize improvement of a heat transfer property between the tabular members 12 and 13 and the cooling pipe 14. Since the cooling pipe 14 is disposed along substantially the entire peripheral edge of the optical element 11, enlargement of a heat transfer area is realized. Therefore, the optical element 11 is effectively cooled by the cooling fluid flowing through the cooling pipe 14.

In the structure in which the cooling pipe 14 is disposed inside the frame members (the tabular members 12 and 13) holding the optical element 11, a risk of fluid leakage is low because only a relatively small joining portion is required for forming a channel for the cooling fluid. Further, a piping resistance is low because the channel, which is uniform and smooth in a flowing direction of the fluid, is formed. In particular, in this example, turbulence of a flow is small because the sectional shape of the cooling pipe 14 is kept to be a substantially circular shape. Moreover, in this structure, the frame members function as both holding means and cooling means for the optical element 11. As a result, there is an advantage that a reduction in size of an apparatus including the optical device 11 is easily realized.

Manufacturing method for a first cooling unit

Figure 3A:
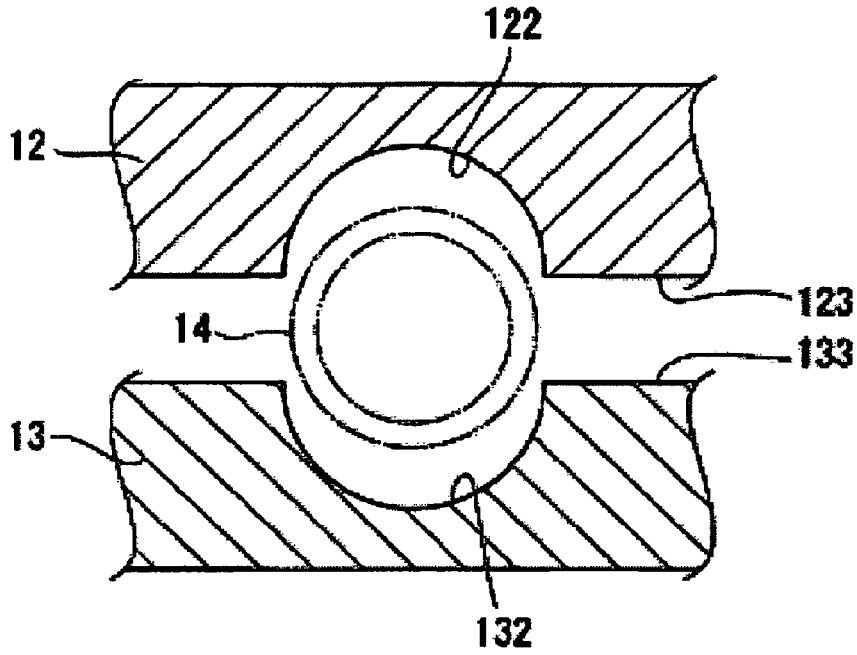
FIGS. 3*a* and 3B are diagrams for explaining an example of a manufacturing method for the cooling unit.
Figure 3B:
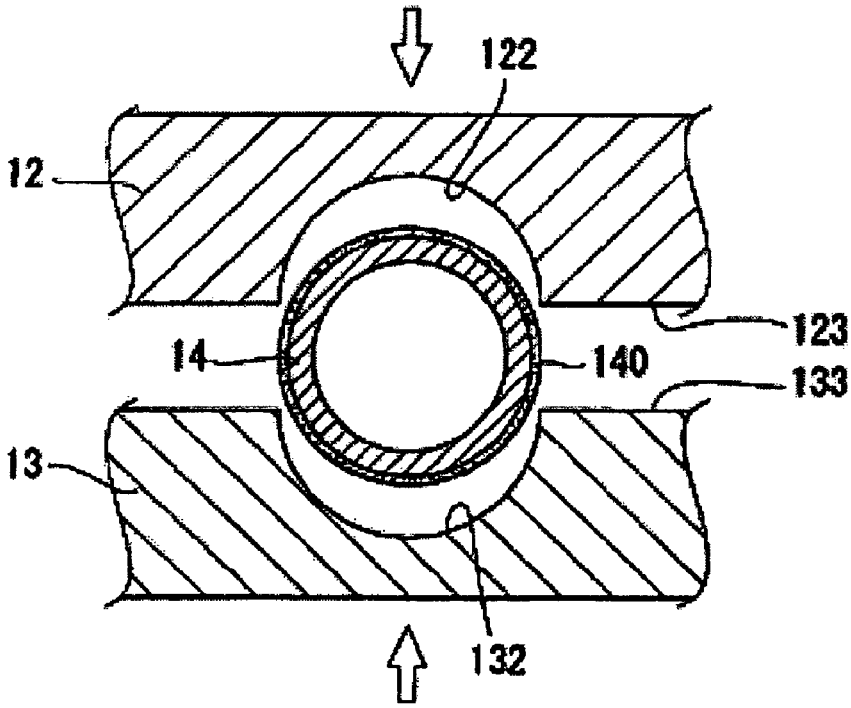

A manufacturing method for the cooling unit 10 will be explained. FIGS. 3A and 3B are diagrams for explaining an example of the manufacturing method for the cooling unit 10. The manufacturing method includes a groove forming step, a combining step, and a filling step. In this example, the filling step is included in the combining step.

First, in the groove forming step, as shown in FIG. 3A, the grooves 122 and 132 of a substantially semicircular shape or a substantially U shape in section for housing a cooling pipe are formed in the respective opposed surfaces 123 and 133 of the pair of tabular members 12 and 13. In this step, the tabular member 12 (13) including the groove 122 (132) is integrally formed using a casting method (a die cast method, etc.) or a forging method (cold/hot forging, etc.). In the casting method, for example, a melted material is poured into a die of a predetermined shape and coagulated to obtain a tabular member of a desired shape. In the forging method, for example, a material member is sandwiched between a pair of dies and compressed to obtain a tabular member of a desired shape. It is possible to form the tabular members 12 and 13 of such a shape easily and at low cost by using the casting method (the die cast method, etc.) or the forging method (the cold/hot forming, etc.). The groove forming step is preferable applied to a small object as well. Since a shape of the tabular members 12 and 13 are simple, it is possible to form the tabular members 12 and 13 easily and at low cost even if cutting is used.

Figure 4:
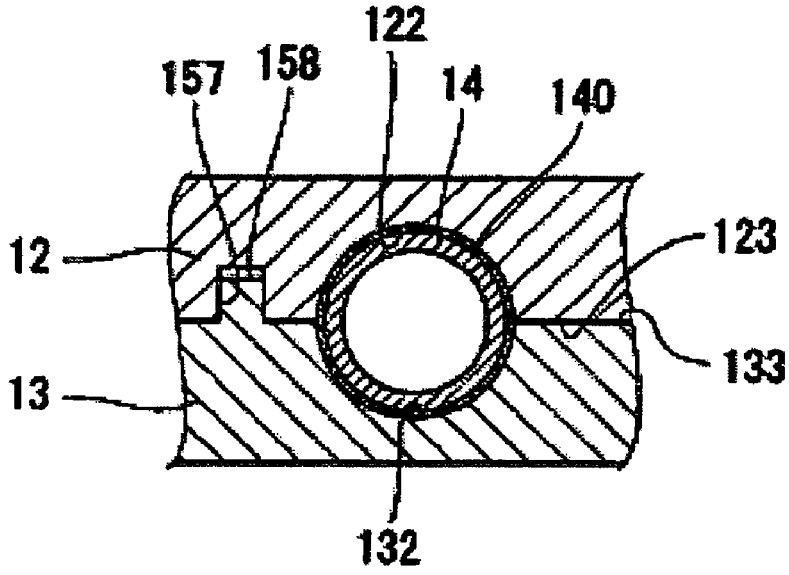
FIG. 4 is a diagram showing an example of a state at the time when the tabular members are combined.

Subsequently, in the combining step (the filling step), as shown in FIG. 3B, the tabular member 12 and the tabular member 13 are arranged to be opposed to each other and the cooling pipe 14 is housed in the respective grooves 122 and 132. In this case, as shown in FIG. 4, a recess 157 and a projection 158 for positioning may be provided in the tabular members 12 and 13 and combined to decide two-dimensional relative positions of the tabular member 12 and the tabular member 13. Prior to the housing, the heat conduction material 140 is applied to inner surfaces of the grooves 122 and 132 and/or an outer surface of the cooling pipe 14. It is possible to use various methods such as a spin coat method, a spray coat method, a roll coat method, a die coat method, a dip coat method, and a droplet jetting method for the application of the heat conduction material 140.

Figure 5:
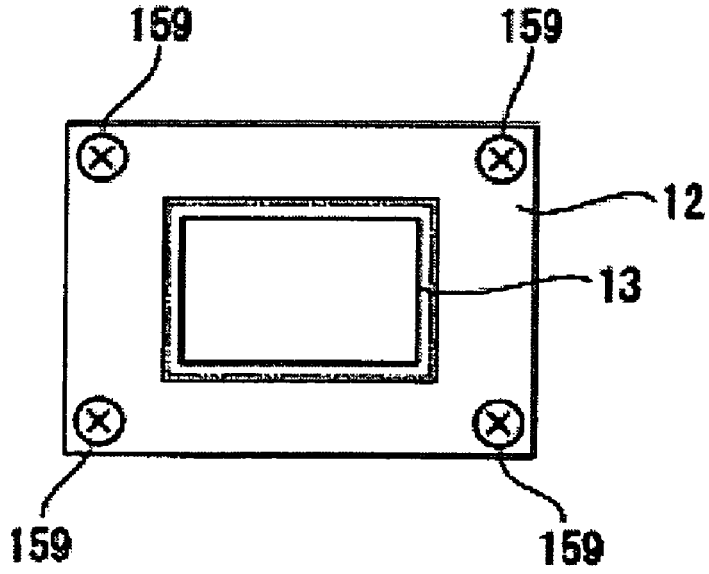
FIG. 5 is a diagram showing a state of combination of the tabular members using screws.

After the application of the heat conduction material 140, as shown in FIG. 3B, an external force is applied to bring the opposed surface 123 of the tabular member 12 and the opposed surface 133 of the tabular member 13 into close contact with each other in a state in which the cooling pipe 14 is housed in the respective grooves 122 and 132. Consequently, the heat conduction material 140 is filled in the gap between the grooves 122 and 132 of the respective tabular members 12 and 13 and the cooling pipe 14. Thereafter, the tabular member 12 and the tabular member 13 are combined. It is possible to perform the combination using at least one of fastening by screws 159 shown in FIG. 5, bonding, welding, and mechanical combination such as fitting. When an adhesive force of the heat conduction material 140 is sufficiently large, it is also possible to omit the combination by the method other than bonding.

At the time of the combination, the heat conduction material 140 is softened and fluidized as required. For example, when the heat conduction material 140 is thermoplastic, the heat conduction material 140 is heated at the time of the combination. In this case, for example, the tabular members 12 and 13 are heated via an object (a jig) holding the tabular members 12 and 13 or a high-temperature fluid is caused to flow through the cooling pipe 14. Since the heat conduction material 140 is softened and fluidized at the time of combination of the tabular members 12 and 13, the heat conduction material 140 is filled in the entire area of the gap between the grooves 122 and 132 of the tabular members 12 and 13 and the cooling pipe 14.

Through the steps described above, a cooling structure (a cooling plate) having a structure in which the pair of tabular members 12 and 13 are arranged to be opposed to each other across the cooling pipe 14 is manufactured.

Thereafter, as shown in FIGS. 1A and 1B, the cooling unit 10 is completed by fixing the optical element 11 to the tabular members 12 and 13 and connecting the cooling pipe 14 to the supply system of the cooling fluid.

As explained above, in the manufacturing method for the cooling unit 10 in this example, since the heat conduction material 140 is used, it is possible to thermally connect the respective tabular members 12 and 13 and the cooling pipe 14 without expanding the diameter of the cooling pipe 14. Since the step of expanding the diameter of the cooling pipe 14 is made unnecessary, it is possible to significantly reduce the manufacturing time and preferably apply the manufacturing method to the small-diameter cooling pipe 14 as well. Therefor, according to this manufacturing method, it is possible to realize a reduction in cost and a reduction in size of the cooling unit 10 to be manufactured.

The heat conduction material 140 may be filled (injected) in the gap between the respective grooves 122 and 132 of the tabular members 12 and 13 and the cooling pipe 14 after combining the pair of tabular members 12 and 13 with each other.

It is preferable that the heat conduction material 140 has elasticity in an operating temperature range of the cooling plate (the tabular members 12 and 13). Since the heat conduction material 140 has elasticity, the heat conduction material 140 expands and contracts according to a change of the gap between the tabular members 12 and 13 and the cooling pipe 14 involved in thermal deformation or the like. Thus, thermal connection between the tabular members 12 and 13 and the cooling pipe 14 are stably maintained.

Figure 6A:
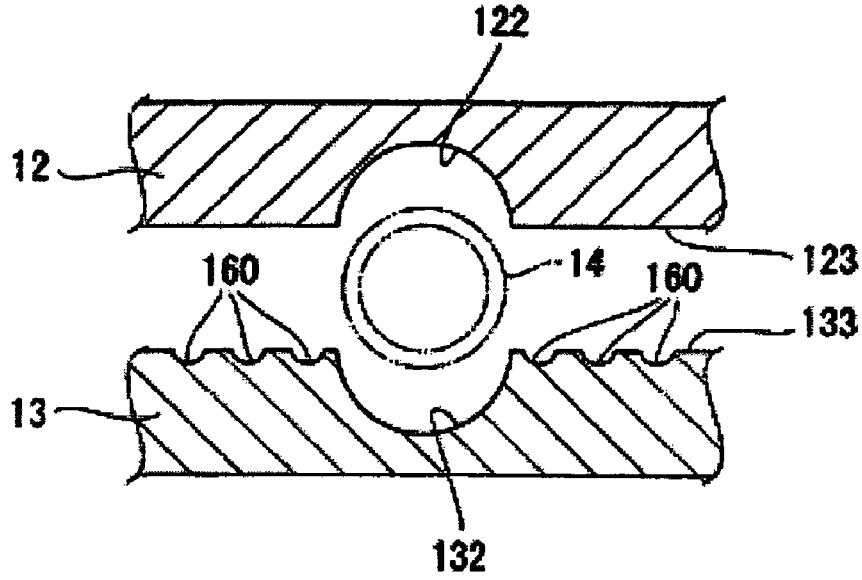
FIGS. 6A and 6B are diagrams for explaining a modification of the manufacturing method for the cooling unit.
Figure 6B:
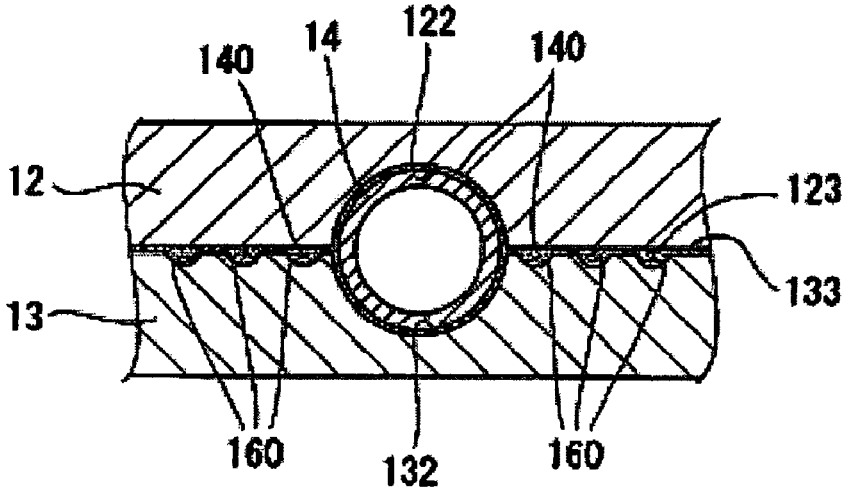

FIGS. 6A and 6B are diagrams for explaining a modification of the manufacturing method shown in FIGS. 3A and 3B. Components having functions identical with those already explained are denoted by the identical reference numerals. Explanations of the components are omitted or simplified.

In an example in FIGS. 6A and 6B, plural supplementary grooves 160 in which the heat conduction material 140 is at least temporarily housed are formed in the opposed surface 133 of the tabular member 13.

In the groove forming step, the groove 122 for housing the cooling pipe 14 is formed in the opposed surface 123 of one tabular member 12 and the groove 132 for housing the cooling pipe 14 and the supplementary grooves 160 provided adjacently to the groove 132 are formed in the opposed surface 133 of the other tabular member 13 (FIG. 6A). The supplementary grooves 160 are formed substantially parallel to the groove 132 on both the outer sides of the groove 132 in the opposed surface 133 of the tabular member 13. The plural supplementary grooves 160 are disposed to be apart from one another. A shape and the number of the supplementary grooves 160 are appropriately set according to a material characteristic and the like of the heat conduction material 140. It is possible to form even the tabular member 13 of such a shape easily and at low cost by using the casting method (the die cast method, etc.) or the forging method (the cold/hot forging, etc.). The same supplementary grooves may be provided in the opposed surface 123 of the tabular member 12.

In the combining step (the filling step), prior to the housing of the cooling pipe 14 in the grooves 122 and 132, the heat conduction material 140 is applied on the inner surfaces of the grooves 122 and 132 and/or the outer surfaces of the cooling pipe 14. After the application of the heat conduction material 140, an external force is applied to bring the opposed surface 123 of the tabular member 12 and the opposed surface 133 of the tabular member 13 into close contact with each other in a state in which the cooling pipe 14 is housed in the respective grooves 122 and 132. Consequently, the heat conduction material 140 is filled in the gap between the grooves 122 and 132 of the respective tabular members 12 and 13 and the cooling pipe 14 (FIG. 6B). In this case, the heat conduction material 140 is softened and fluidized by heating or the like as required. An excess of the heat conduction material 140 flows to the supplementary grooves 160 and stored therein. Thereafter, the tabular member 12 and the tabular member 13 are combined.

In this example, since the supplementary grooves 160 are formed in the opposed surface 133 of the tabular member 13, the excess of the heat conduction material 140 is stored in the supplementary grooves 160. Since places to which the heat conduction material 140 escapes are provided, the heat conduction material 140 tends to uniformly spread. Thus, the heat conduction material 140 is more surely arranged in the entire area of the gap between the grooves 122 and 132 of the tabular members 12 and 13 and the cooling pipe 14. The heat conduction material 140 arranged in the supplementary grooves 160 (or the gap between the opposed surfaces 123 and 133) has a function of improving thermal connectivity between the tabular member 12 and the tabular member 13.

When the heat conduction material 140 has an adhesive force, since an arrangement area of the heat conduction material 140 is expanded, a bonding area between the tabular member 12 and the tabular member 13 is expanded to improve the combining force between the tabular member 12 and the tabular member 13 by the heat conduction material 140. As a result, it is possible to omit the combination by the other methods such as fastening by screws or the like.

The heat conduction material 140 may have fluidity in the operating temperature range of the cooling plate (tabular members 12 and 13). In this case, when a capacity of the gap between the grooves 122 and 132 of the tabular members 12 and 13 and the cooling pipe 14 changes following thermal deformation or the like, the heat conduction material 140 appropriately moves between the gap and the supplementary grooves 160. Thus, a filling state of the heat conduction material 140 in the gap is kept and the thermal connection between the tabular members 12 and 13 and the cooling pipe 14 is stably maintained. In this case, it is preferable that measures for preventing the heat conduction material 140 from leaking out to the outside are taken. For example, it is also possible that a heat conduction material other than an anaerobic type material is used and the heat conduction material is caused to harden in a part in contact with the external air and hold fluidity in the inside thereof. Alternatively, it is also possible that a heat conduction agent having fluidity in the operating temperature range is arranged on the inner side and another heat conduction material to be hardened is arranged on the outer side.

Figure 7:
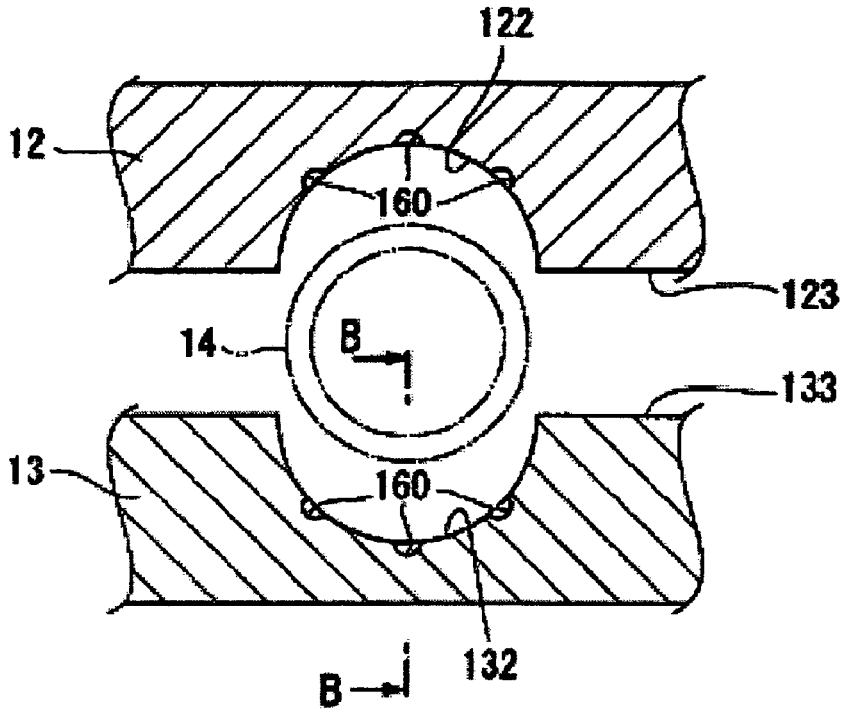
FIG. 7 is a diagram showing an example of another form of supplementary grooves.
Figure 7:
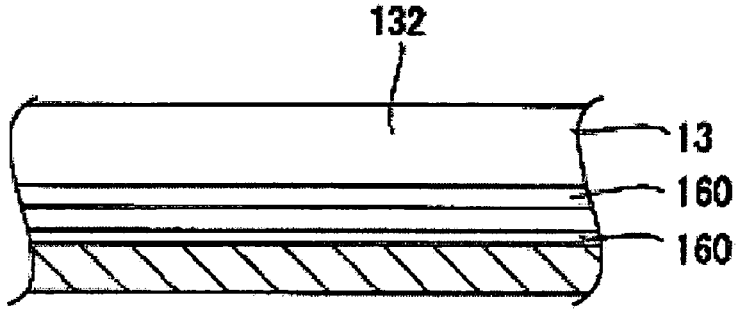
Figure 8:
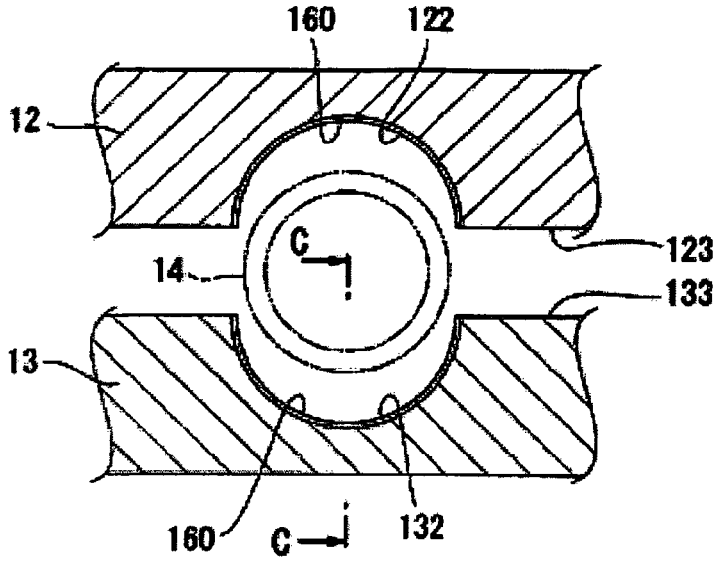
FIG. 8 is a diagram showing an example of still another form of the supplementary grooves.
Figure 8:
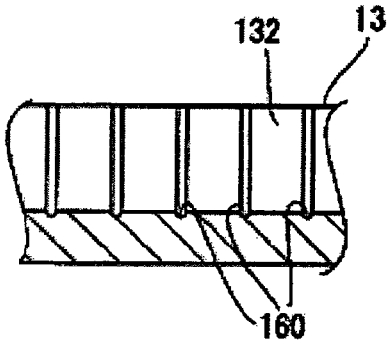

FIGS. 7 and 8 show examples of other forms of the supplementary grooves 160.

In an example in FIG. 7, the supplementary grooves 160 are formed in the inner surfaces of the respective grooves 122 and 132 of the tabular members 12 and 13 to extend in an axial direction of the grooves 122 and 132. The plural supplementary grooves 160 are disposed to be apart from one another in the circumferential direction of the grooves 122 and 132.

In an example in FIG. 8, the supplementary grooves 160 are formed in the inner surfaces of the respective grooves 122 and 132 of the tabular members 12 and 13 to extend in the circumferential direction of the grooves 122 and 123. The plural supplementary grooves 160 are disposed to be apart from one another in the axial direction of the grooves 122 and 132. In FIG. 8, the supplementary grooves 160 may be formed such that depth thereof gradually decreases from the bottom of the groove 122 (132) toward the top thereof.

It is possible to form even the tabular members 12 and 13 of such a shape easily and at low cost by using the casting method (the die cast method, etc.) or the forging method (the cold/hot forging, etc.).

In the examples in FIGS. 7 and 8, the supplementary grooves 160 are formed in the inner surfaces of the respective grooves 122 and 132 of the tabular members 12 and 13. Thus, the excess of the heat conduction material 140 easily moves to the supplementary grooves 160 when the heat conduction material 140 is filled. As a result, the heat conduction material 140 tends to uniformly spread and the heat conduction material 140 is more surely arranged in the entire area of the gap between the grooves 122 and 132 of the tabular members 12 and 13 and the cooling pipe 14.

The supplementary grooves 160 may be provided in both the grooves 122 and 132 of the tabular members 12 and 13 and the opposed surfaces 123 and 133.

Figure 9:
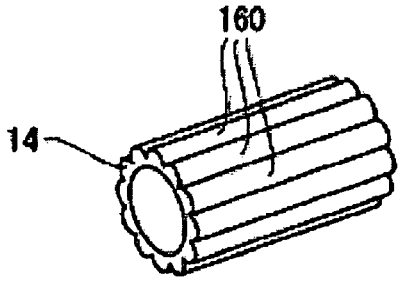
FIG. 9 is a diagram showing an example in which the supplementary grooves are formed in a cooling pipe.
Figure 10:
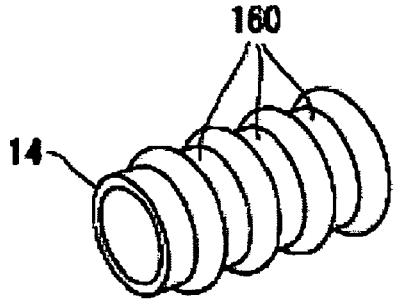
FIG. 10 is a diagram showing an example in which the supplementary grooves are formed in the cooling pipe.
Figure 11:
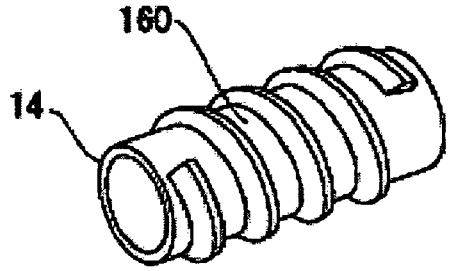
FIG. 11 is a diagram showing an example in which the supplementary grooves are formed in the cooling pipe.

FIGS. 9, 10, and 11 show examples in which the supplementary grooves 160 are formed in the outer surface of the cooling pipe 14.

In the example in FIG. 9, the supplementary grooves 160 are formed in the outer surface of the cooling pipe 14 to extend in the axial direction of the cooling pipe 14. The plural grooves 160 are disposed to be apart from one another in the circumferential direction of the cooling pipe 14.

In the example in FIG. 10, the supplementary grooves 160 are formed in the outer surface of the cooling pipe 14 to extend in the circumferential direction of the cooling pipe 14. The plural supplementary grooves 160 are disposed to be apart from one another in the axial direction of the cooling pipe 14.

In the example in FIG. 11, the supplementary grooves 160 are formed in a spiral shape in the outer surface of the cooling pipe 14.

In the examples in FIGS. 9, 10, and 11, since the supplementary grooves 160 are formed in the outer surface of the cooling pipe 14, the excess of the heat conduction material 140 easily moves to the supplementary grooves 160 when the heat conduction material 140 is filled. As a result, the heat conduction material 140 tends to uniformly spread and the heat conduction material 140 is more surely arranged in the entire area of the gap between the grooves 122 and 132 of the tabular members 12 and 13 and the cooling pipe 14.

Second Embodiment

A second embodiment of the invention will be explained with reference to the drawings. In the respective figures, dimensions of components are made different from actual dimensions as required in order to set sizes of the components to be recognizable on the drawings. Components having functions identical with those already explained are denoted by the identical reference numerals. Explanations of the components are omitted or simplified.

Second Cooling Unit

Figure 12:
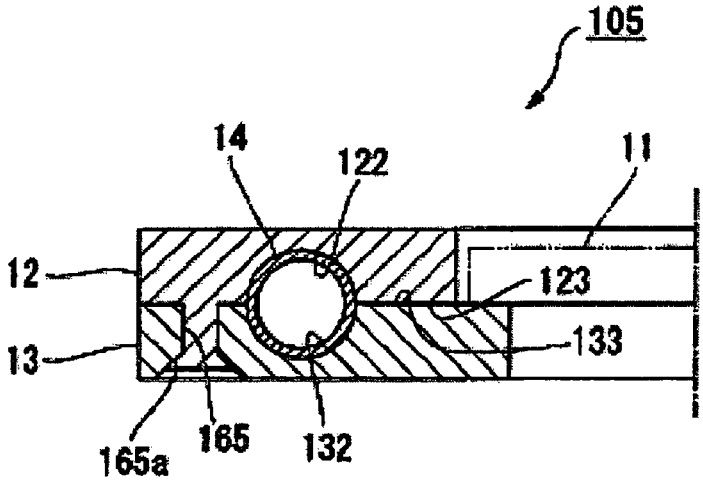
FIG. 12 is a sectional view showing a second cooling unit.

FIG. 12 is a sectional view showing a cooling unit 105 in this embodiment. The cooling unit 105 is a unit that holds the peripheral edge of the optical element 11 and cools the optical elements 11 in the same manner as the cooling unit 10 in FIGS. 1A and 1B. The cooling unit 105 includes the pair of tabular members 12 and 13 that hold the optical element 11 and the cooling pipe 14 that is sandwiched by the pair of tabular members 12 and 13.

Unlike the cooling unit 10 in FIGS. 1A and 1B, in the cooling unit 105 in this embodiment, one tabular member 12 is formed by insert molding.

A thermal good conductor made of a material having a high thermal conductivity is used as the tabular member 13 (the first tabular member). For example, various kinds of metals are adopted other than aluminum, (234 W/(m·K)), magnesium (156 W/(m·K)), and alloys of aluminum and magnesium (an aluminum alloy (about 100 W/(m·K)), a low specific gravity magnesium alloy (about 50 W/(m·K)), etc.). The tabular member 13 is not limited to a metal material and may be other materials (a resin material, etc.) having a high thermal conductivity (e.g., equal to or higher than 5 W/(m·K)).

On the other hand, as the tabular member 12 (the second tabular member), a resin material having a low melting point compared with those of the tabular member 13 and the cooling pipe 14 is used. For example, a resin material mixed with a metal material, a resin material mixed with a carbon material, or the like is used. A thermal conductivity of the resin material is preferably equal to or higher than 3 W/(m·K) and more preferably equal to or higher than 5 W(m·K). As the resin material mixed with a metal material or a carbon material, there is a resin material having a thermal conductivity equal to or higher than 3 W/(m·K) and a resin material having a thermal conductivity equal to or higher than 10 W/(m·K). As an example, there are D2 (registered trademark) (an LCP resin mixed with a material for heat transfer), 15 W/(m·K), coefficient of thermal expansion: 10×10^−6/k) and RS007 (registered trademark) (a PPS resin mixed with a material for heat transfer, 3.5 W/(m·K), coefficient of thermal expansion: 20×10^−6/K) manufactured by Cool Polymers, Inc.

The cooling pipe 14 is made of, for example, a pipe or a tube that has an annular section and extends along a center axis of the section. The cooling pipe 14 is bent according to a geometry of the grooves 122 and 132 of the tabular members 12 and 13. As the cooling pipe 14, a thermal good conductor made of a material having a high thermal conductivity is preferably used. For example, various kinds of metal are adopted other than aluminum (234 W/(m·K)), copper (398 W/(m·K)), stainless steel (16 W/(m·K) (austenitic)), and alloys of aluminum, copper, and stainless steel.

As a combination of materials of the tabular member 13 (the first tabular member), the tabular member 12 (the second tabular member), and the cooling pipe 14, it is preferable that coefficients of thermal expansion of the materials are substantially the same.

As an example, there is a combination of the tabular member 13 and the cooling pipe 14 made of copper (coefficient of thermal expansion: 16.6×10^−6/K) or stainless steel (austenitic, coefficient of thermal expansion: 13.6×10^−6/K) and the tabular member 12 made of the resin material having a high thermal conductivity (coefficient of thermal expansion: 10 to 20×10^−6/K).

The groove 132 in which the cooling pipe 14 is housed and a through-hole 165 serving as an engaging section are provided in the opposed surface 133 of the tabular member 13. The through-hole 165 is formed to have, near an opening on an opposite side of the opposed surface 133, a slope 165*a* of a taper shape, an area of which increases toward the opening. An opening having a step may be provided instead of the opening of the taper shape. It is possible to arbitrarily set a shape and the number of through-holes 165. At the time of insert molding of the tabular member 12, a material forming the tabular member 12 is filled in the inside of the through-hole 165 of the tabular member 13, whereby the tabular member 12 and the tabular member 13 are combined. Consequently, the tabular members 12 and 13 and the cooling pipe 14 are thermally connected to one another.

Manufacturing Method for the Second Cooling Unit

A manufacturing method for the cooling unit 105 will be explained.

Figure 13A:
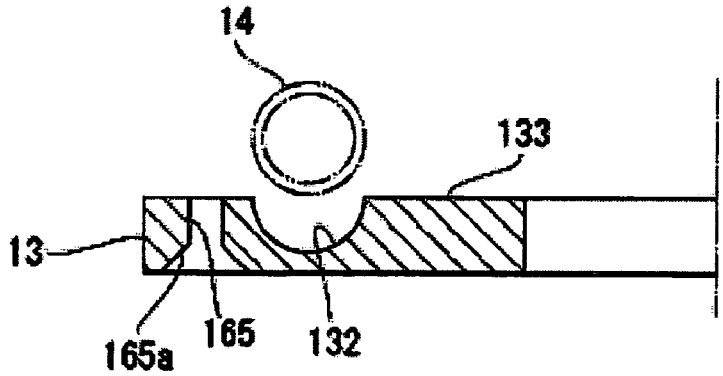
FIGS. 13A and 13B are diagrams for explaining a manufacturing method for the second cooling unit.
Figure 13B:
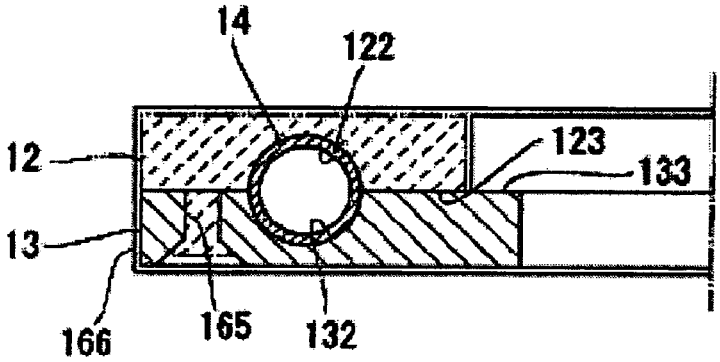

FIGS. 13A and 13B are diagrams for explaining an example of the manufacturing method for the cooling unit 105. This manufacturing method includes a groove forming step and a combining step.

First, in the groove forming step, as shown in FIG. 13A, the groove 132 of a substantially semicircular shape or a substantially U shape in section for housing the cooling pipe 14 and the through-hole 165 for combination are formed in the opposed surface 133 of the tabular member 13 (the first tabular member). As described above, the through-hole 165 has, near the opening on the opposite side of the opposed surface 133, the slope 165*a* of a taper shape, an area of which increases toward the opening. In this step, the tabular member 13 including the groove 132 and the through-hole 165 is integrally formed using the casting method (the die cast method, etc.) or the forging method (cold/hot forging, etc.). In the casting method, for example, a melted material is poured into a die of a predetermined shape and coagulated to obtain a tabular member of a desired shape. In the forging method, for example, a material member is sandwiched between a pair of dies and compressed to obtain a tabular member of a desired shape. It is possible to form the tabular member 13 of such a shape easily and at low cost by using the casting method (the die cast method, etc.) or the forging method (the cold/hot forming, etc.). The groove forming step is preferable applied to a small object as well.

Subsequently, in the combining step, as shown in FIG. 13B, the tabular member 12 is formed by insert molding in a state in which the cooling pipe 14 is housed in the groove 132 of the tabular member 13. The tabular member 13 is fixed to a die 166 in a state in which the cooling pipe 14 is housed in the groove 132 of the tabular member 13. A melted material is supplied to the inside of the die 166 (e.g., poured to be supplied or injected to be supplied) and coagulated to obtain the tabular member 12 of a desired shape.

In this molding step, the tabular member 12 is formed to follow external shapes of the tabular member 13 and the cooling pipe 14. Consequently, the groove 122 having an external shape portion (a semicircular sectional shape) substantially the same as the shape of the cooling pipe 14 is formed in the opposed surface 123 of the tabular member 12. Since the material forming the tabular member 12 is filled in the through-hole 165 of the tabular member 13, the portion comes into an engaged state. As a result, the tabular member 12 is held in a state in which the tabular member 12 is in close contact with the tabular member 13 and the cooling pipe 14. The tabular members 12 and 13 and the cooling pipe 14 are thermally connected to each other.

As a combination of materials of the tabular member 13 (the first tabular member), the tabular member 12 (the second tabular member), and the cooling pipe 14, materials having substantially the same coefficients of thermal expansion of are used. Consequently, when the tabular member 12 is hardened and contracted or after the tabular member 12 is molded, a gap due to a difference of an amount of thermal deformation is prevented from being formed between the respective tabular members 12 and 13 and the cooling pipe 14. Thermal connection between the tabular members 12 and 13 and the cooling pipe 14 is stably maintained.

As explained above, in this example, the tabular member 12 is formed around the cooling pipe 14 by insert molding. Thus, the tabular member 12 is formed to follow the external shapes of the cooling pipe 14 and the tabular member 13. The tabular members 12 and 13 and the cooling pipe 14 satisfactorily come into contact with each other. Therefore, improvement of the heat transfer property between the respective tabular members 12 and 13 and the cooling pipe 14 is realized even in the small cooling pipe 14. Further, since the diameter expanding step is made unnecessary, complicated processing such as cutting using a special cutting tool is unnecessary. In other words, according to this manufacturing method, it is possible to realize a reduction in cost and a reduction in size of the cooling unit 105 to be manufactured.

In the cooling unit, since the heat conduction material is filled in the gap between the groove 132 of the tabular member 13 and the cooling pipe 14, it is possible to realize improvement of a heat transfer property between the tabular member 13 and the cooling pipe 14.

As the heat conduction material, a thermal good conductor made of a material having a high thermal conductivity is preferably used. Specifically, for example, a resin material mixed with a metal material, a resin material mixed with a carbon material, hot-melt adhesive, or the like is used. A thermal conductivity of the heat conduction material is preferably equal to or higher than 3 W/(m·K) and more preferably equal to or higher than 5 W/(m·K). A thermal conductivity of hot-melt adhesive is usually equal to or higher than 5 W/(m·K)). As the resin material mixed with a metal material or a carbon material, there is a resin material having a thermal conductivity equal to or higher than 3 W/(m·K) and a resin material having a thermal conductivity equal to or higher than 10 W/(m·K). As an example, there are D2 (registered trademark) (an LCP resin mixed with a material for heat transfer), 15 W/(m·K), coefficient of thermal expansion: 10×10^−6/k), RS007 (registered trademark) (a PPS resin mixed with a material for heat transfer, 3.5 W/(m·K), coefficient of thermal expansion: 20×10^−6/K) manufactured by Cool Polymers, Inc.

It is possible to fill the heat conduction material by, for example, applying the heat conduction material on the inner surface of the groove 132 of the tabular member 13 and/or the outer surface of the cooling pipe 14 prior to housing the cooling pipe 14 in the groove 132 of the tabular member 13. It is possible to use various methods such as a spin coat method, a spray coat method, a roll coat method, a die coat method, a dip coat method, and a droplet jetting method for the application of the heat conduction material.

When the cooling pipe 14 is housed in the groove 132 of the tabular member 13 after the application of the heat conduction material, the tabular member 13 and the cooling pipe 14 are thermally connected directly in a part where the groove 132 of the tabular member 13 and the cooling pipe 14 are in contact with each other. The tabular member 13 and the cooling pipe 14 are thermally connected indirectly via the heat conduction material in a part where the gap is formed. In other words, heat transfer between the tabular member 13 and the cooling pipe 14 is supplemented by the heat conduction material to realize improvement of the heat transfer property between the tabular member 13 and the cooling pipe 14. When the heat conduction material has an adhesive force, it is also possible to use the an adhesive force for a combining force or the like between the tabular member 13 and the cooling pipe 14.

At the time of the combination, it is advisable to soften and fluidize the heat conduction material as required. For example, when the heat conduction material is thermoplastic, the heat conduction material is heated at the time of the combination. In this case, for example, heat at the time of molding of the tabular member 12 is used or a high-temperature fluid is caused to flow through the cooling pipe 14. Since the heat conduction material is softened and fluidized, the heat conduction material is filled in the entire area of the gap between the groove 132 of the tabular member 13 and the cooling pipe 14.

In this case, it is preferable that the heat conduction material has elasticity in an operating temperature range of the cooling plate (the tabular members 12 and 13). Since the heat conduction material has elasticity, the heat conduction material expands and contracts according to a change of the gap between the tabular members 12 and 13 and the cooling pipe 14 involved in thermal deformation or the like. Thus, thermal connection between the tabular members 12 and 13 and the cooling pipe 14 are stably maintained.

Figure 14:
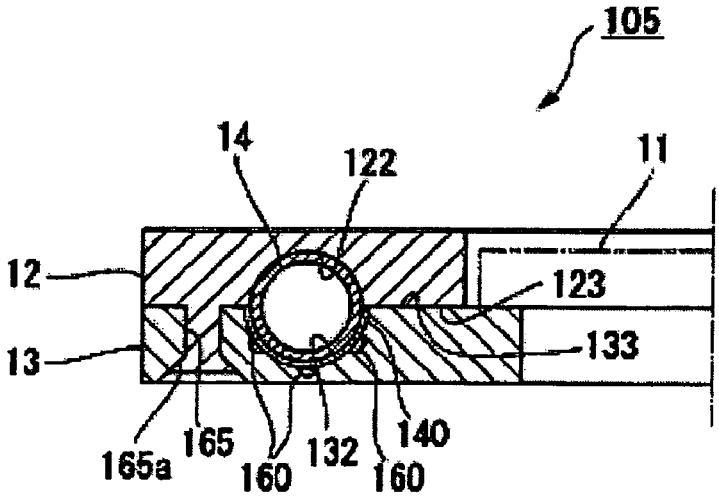
FIG. 14 is a sectional view showing a modification of the second cooling unit.
Figure 15:
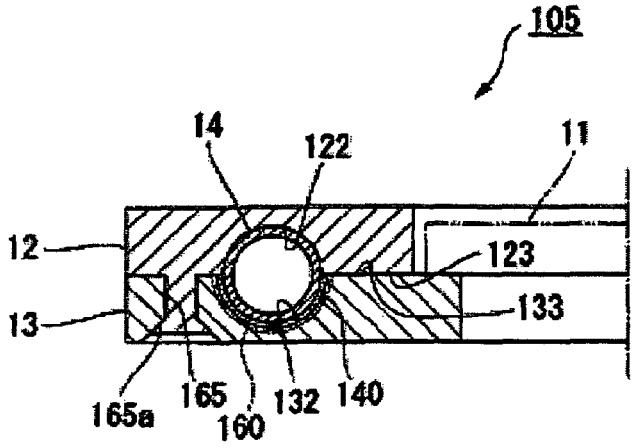
FIG. 15 is a sectional view showing a modification of the second cooling unit.

FIGS. 14 and 15 are diagrams for explaining modifications of the cooling unit 105 in FIG. 12. Components having functions identical with those already explained are denoted by the identical reference numerals. Explanations of the components are omitted or simplified.

As shown in FIGS. 14 and 15, in the examples, the heat conduction material 140 is filled in the gap between the groove 132 of the tabular member 13 and the cooling pipe 14. Improvement of the heat transfer property between the tabular member 13 and the cooling pipe 14 is realized by filling the heat conduction material 140. The supplementary grooves 160 in which the heat conduction material 140 is at least temporarily stored are formed in the inner surface of the groove 132 of the tabular member 13.

In the example in FIG. 14, as in the example shown in FIG. 7, the plural supplementary grooves 160, which extend in the axial direction of the groove 132 and are arranged to be apart from one another in the circumferential direction, are formed in the inner surface of the groove 132 of the tabular member 13.

In the example in FIG. 15, as in the example shown in FIG. 8, the plural supplementary grooves 160, which extend in the circumferential direction of the groove 132 and are arranged to be apart from one another in the axial direction, are formed in the inner surface of the groove 132 of the tabular member 13. In the example in FIG. 15, the supplementary grooves 160 may have a shape in which depth thereof gradually decreases from the bottom of the groove 132 toward the top thereof.

In a manufacturing process for the cooling unit 105 in FIG. 14 or 15, in a groove forming step, the groove 132 for housing the cooling pipe 14 in the opposed surface 133 of the tabular member 13 is formed and the supplementary grooves 160 are formed in the inner surface of the groove 132. A shape and the number of the supplementary grooves 160 are appropriately set according to a material characteristic and the like of the heat conduction material 140. The tabular member 13 having such a shape is formed easily and at low cost by using the casting method (the die cast method, etc.) or the forging method (the cold/hot forging, etc.).

In a combining step, prior to housing the cooling pipe 14 in the groove 132, the heat conduction material 140 is applied on the inner surface of the groove 132 and/or the outer surface of the cooling pipe 14. After the application of the heat conduction material 140, as in the example shown in FIG. 13B, the tabular member 12 is formed by insert molding in a state in which the cooling pipe 14 is housed in the groove 132. Consequently, the tabular member 12 and the tabular member 13 are combined and the heat conduction material 140 is filled in the gap between the groove 132 of the tabular member 13 and the cooling pipe 14. In this case, the heat conduction material 140 is softened and fluidized by heating or the like as required. An excess of the heat conduction material 140 flows to the supplementary grooves 160 and are stored therein. When the heat conduction material 140 is thermoplastic, it is advisable to heat the heat conduction material 140 at the time of the combination. For example, heat at the time of molding of the tabular member 12 is used or a high-temperature fluid is caused to flow into the cooling pipe 14. Since the heat conduction material is softened and fluidized, the heat conduction material is filled in the entire area of the gap between the groove 132 of the tabular member 13 and the cooling pipe 14.

In this example, since the supplementary grooves 160 are formed in the inner surface of the groove 132 of the tabular member 13, the excess of the heat conduction material 140 is stored in the supplementary grooves 160. Since places to which the heat conduction material 140 escapes are provided, the heat conduction material 140 tends to uniformly spread. Thus, the heat conduction material 140 is more surely arranged in the entire area of the gap between the groove 132 of the tabular member 13 and the cooling pipe 14. The heat conduction material 140 arranged in the supplementary grooves 160 improves thermal connectivity between the cooling pipe 14 and the tabular member 13.

When the heat conduction material 140 has an adhesive force, according to expansion of an arrangement area of the heat conduction material 140, a bonding area between the cooling pipe 14 and the tabular member 13 increases and the combining force between the cooling pipe 14 and the tabular member 13 by the heat conduction material 140 is improved.

The heat conduction material 140 may have fluidity in the operating temperature range of the cooling plate (tabular member 13). In this case, when a capacity of the gap between the groove 132 of the tabular member 13 and the cooling pipe 14 changes following thermal deformation or the like of the tabular member 13 and/or the cooling pipe 14, the heat conduction material 140 appropriately moves between the gap and the supplementary grooves 160. As a result, a filling state of the heat conduction material 140 in the gap is kept and the thermal connection between the tabular member 13 and the cooling pipe 14 is stably maintained. In this case, it is preferable that measures for preventing the heat conduction material 140 from leaking out to the outside are taken. For example, it is also possible that a heat conduction material other than an anaerobic type material is used and the heat conduction material is caused to harden in a part in contact with the external air and hold fluidity in the inside thereof. Alternatively, it is also possible that a heat conduction agent having fluidity in the operating temperature range is arranged on the inner side and another heat conduction material to be hardened is arranged on the outer side.

As another modification of the cooling unit 105 in FIG. 12, the supplementary grooves 160 may be provided in the outer surface of the cooling unit 14 as shown in FIG. 9, 10, or 11.

As shown in FIG. 9, the plural supplementary grooves 160, which are arranged to be apart from one another in the circumferential direction of the cooling pipe 14 and have a shape extending in the axial direction, may be formed in the outer surface of the cooling pipe 14.

Alternatively, as shown in FIG. 10, the plural supplementary grooves 160, which are arranged to be apart from one another in the axial direction of the cooling pipe 14 and have a shape extending in the circumferential direction, may be formed in the outer surface of the cooling pipe 14.

Alternatively, as shown in FIG. 11, the supplementary grooves 160 having a spiral shape may be formed in the outer surface of the cooling pipe 14.

Since the supplementary grooves 160 are formed in the outer surface of the cooling pipe 14, the excess of the heat conduction material 140 easily moves to the supplementary grooves 160 when the heat conduction material 140 is filled. As a result, the heat conduction material 140 tends to uniformly spread and the heat conduction material 140 is more surely arranged in the entire area of the gap between the groove 132 of the tabular member 13 and the cooling pipe 14.

Third Embodiment

A third embodiment of the invention will be explained. In the respective figures, dimensions of components are made different from actual dimensions as required in order to set sizes of the components to be recognizable on the drawings. Components having functions identical with those already explained are denoted by the identical reference numerals. Explanations of the components are omitted or simplified.

Third Cooling Unit

Figure 16:
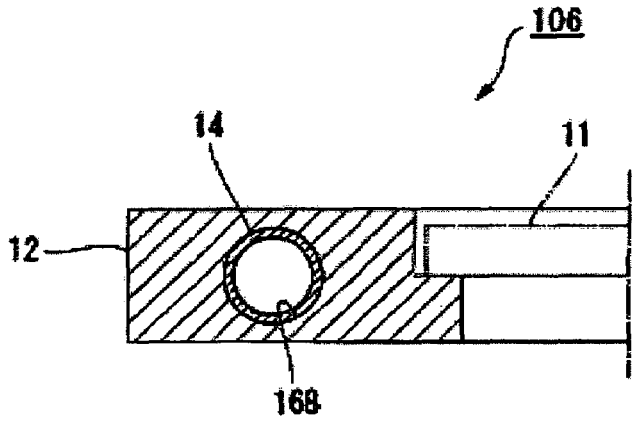
FIG. 16 is a sectional view showing a third cooling unit.

FIG. 16 is a sectional view showing the cooling unit 106 in this embodiment. The cooling unit 106 is a unit that holds the peripheral edge of the optical element 11 and cools the optical element 11 in the same manner as the cooling unit 10 in FIGS. 1A and 1B. The cooling unit 106 includes the tabular member 12 that holds the optical element 11 and the cooling pipe 14 that is arranged inside the tabular member 12.

Unlike the cooling unit 10 in FIGS. 1A and 1B, in the cooling unit 106 in this embodiment, one tabular member 12 is formed around the cooling pipe 14 by insert molding.

As the tabular member 12, a thermal good conductor made of a material having a high thermal conductivity is preferably used. For example, various kinds of metal are adopted other than aluminum (234 W/(m·K)), magnesium (156 W/(m·K)), and alloys of aluminum and magnesium (an aluminum alloy (about 100 W/(m·K)), a low specific gravity magnesium alloy (about 50 W/(m·K)), etc.). The tabular member 12 is not limited to a metal material and may be other materials (a resin material, etc.) having a high thermal conductivity (e.g., equal to or higher than 5 W/(m·K)).

The cooling pipe 14 is made of, for example, a pipe or a tube that has an annular section and extends along a center axis of the section. The cooling pipe 14 is bent according to a geometry of the grooves 122 and 132 of the tabular members 12 and 13. As the cooling pipe 14, a thermal good conductor made of a material having a high thermal conductivity is preferably used. For example, various kinds of metal are adopted other than aluminum (234 W/(m·K)), copper (398 W/(m·K)), stainless steel (16 W/(m·K) (austenitic)), and alloys of aluminum, copper, and stainless steel.

As a combination of materials of the tabular member 12 and the cooling pipe 14, it is preferable that a material of the tabular member 12 has a low melting point and a high coefficient of thermal expansion compared with a material of the cooling pipe 14.

As an example, there is a combination of the tabular member 12 made of an aluminum alloy (melting point: 580° C., coefficient of thermal expansion: 22×10^−6/K) and the cooling pipe 14 made of copper (melting point: 1083° C., coefficient of thermal expansion: 16.6×10^−6/K) or a combination of the tabular member 12 made of a low specific gravity magnesium alloy (melting point: 650° C., coefficient of thermal expansion: 27×10^−6/K) and the cooling pipe 14 made of copper (melting point: 1083° C., coefficient of thermal expansion: 16.6×10^−6/K).

Since the tabular member 12 is formed around the cooling pipe 14 by molding, the tabular member 12 and the cooling pipe 14 are thermally connected to each other.

Manufacturing Method for the Third Cooling Unit

Figure 17:
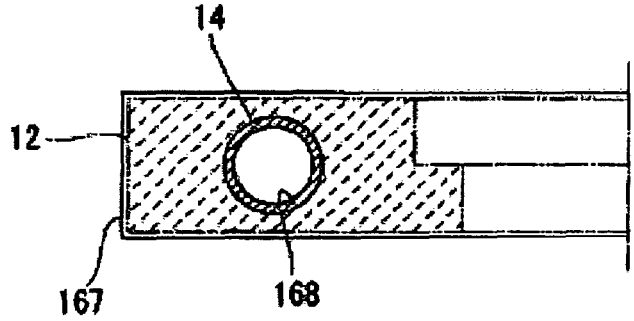
FIG. 17 is a diagram for explaining a manufacturing method for the third cooling unit.

A manufacturing method for the cooling unit 106 will be explained. FIG. 17 is a diagram for explaining an example of the manufacturing method for the cooling unit 106. This manufacturing method includes a molding step.

As shown in FIG. 17, the tabular member 12 is formed around the cooling pipe 14 by insert molding. Specifically, the cooling pipe 14 is fixed to the mold 167, a melted material is supplied to the inside of the mold 167 (e.g., poured to be supplied or injected to be supplied), and the material is coagulated to obtain the tabular member 12 of a desired shape.

In this molding step, the tabular member 12 is formed to follow an external shape of the cooling pipe 14 and a hole 168 having an external shape portion (a circular shape in section) substantially the same as the shape of the cooling pipe 14 is formed inside the tabular member 12. As a result, the tabular member 12 and the cooling pipe 14 are held in a close-contact state and the tabular member 12 and the cooling pipe 14 are thermally connected to each other.

As the combination of the materials of the tabular member 12 and the cooling pipe 14, the material of the tabular member 12 has a high coefficient of thermal expansion and a large amount of contraction compared with that of the cooling pipe 14. Thus, a gap is prevented from being formed between the tabular member 12 and the cooling pipe 14, which are surely brought into close contact with each other. In other words, in a process of hardening and contraction of the cooling pipe 14 and the tabular member 12, the cooling pipe 14 is fit in the hole 168 of the tabular member 12 on the basis of a difference of an amount of thermal deformation between the cooling pipe 14 and the tabular member 12. As a result, thermal connection between the cooling pipe 14 and the tabular member 12 is stably maintained.

As explained above, in this example, since the tabular member 12 is formed around the cooling pipe 14 by insert molding, the tabular member 12 is formed to follow the external shape of the cooling pipe 14. The tabular member 12 and the cooling pipe 14 satisfactorily come into contact with each other. Therefore, improvement of the heat transfer property between the tabular member 12 and the cooling pipe 14 is realized even in the small cooling pipe 14. Further, since the diameter expanding step is made unnecessary, complicated processing such as cutting using a special cutting tool is unnecessary. In other words, according to this manufacturing method, it is possible to realize a reduction in cost and a reduction in size of the cooling unit 106 to be manufactured.

As the tabular member 12, it is possible to use a resin material having a low melting point and a high thermal conductivity compared with those of the cooling pipe 14. For example, it is possible to use a resin material mixed with a metal material, a resin material mixed with a carbon material, or the like. A thermal conductivity of the resin material is preferably equal to or higher than 3 W/(m·K) and more preferably equal to or higher than 5 W/(m·K). As the resin material mixed with a metal material or a carbon material, there are a resin material having a thermal conductivity equal to or higher than 3 W/(m·K) and a resin material having a thermal conductivity equal to or higher than 10 W/(m·K). As an example, there are D2 (registered trademark) (an LCP resin mixed with a material for heat transfer), 15 W/(m·K), coefficient of thermal expansion: 10×10^−6/k) and RS007 (registered trademark) (a PPS resin mixed with a material for heat transfer, 3.5 W/(m·K), coefficient of thermal expansion: 20×10^−6/K) manufactured by Cool Polymers, Inc.

In this case, as a combination of materials of the tabular member 12 and the cooling pipe 14, it is preferable that coefficients of thermal expansion of the materials are substantially the same.

As an example, there is a combination of the cooling pipe 14 made of copper (coefficient of thermal expansion: 16.6×10^−6/K) or stainless steel (austenitic, coefficient of thermal expansion: 13.6×10^−6/K) and the tabular member 12 made of the resin material having a high thermal conductivity (coefficient of thermal expansion: 10 to 20×10^−6/K).

As the combination of materials of the tabular member 12 and the cooling pipe 14, materials having substantially the same coefficients of thermal expansion are used. Thus, a gap due to a difference of an amount of thermal deformation is prevented from being formed between the tabular member 12 and the cooling pipe 14 at the time of hardening and contraction or after molding of the tabular member 12. Thermal connection between the tabular member 12 and the cooling pipe 14 is stably maintained.

The cooling units and the manufacturing methods for the cooling units according to the aspects of the invention are preferably applied to various optical devices that require cooling for optical elements. It is possible to realize a reduction in cost and a reduction in size of the optical devices.

Constitution of a Projector

As an example of application of the cooling units, an embodiment of a projector will be hereinafter explained with reference to the drawings. In the embodiment described below, it is possible to apply the cooling units 10, 105, and 106 and the manufacturing methods for the cooling units to a liquid cooling unit 46 described later (see FIG. 18).

In this case, the optical element 11 (see FIGS. 1, 12, and 16) is applied to at least one of liquid crystal panels 441R, 441G, and 441B, incidence side sheet polarizers 442, and emission side sheet polarizers 443 described later (see FIG. 21).

Similarly, the tabular members 12 and 13 are applied to at least one of a liquid crystal panel holding frame 445 (a frame-like member 4451 and a frame-like member 4452), an incidence side sheet polarizer holding frame 446 (a frame-like member 4461 and a frame-like member 4462), and an emission side sheet polarizer holding frame 447 (a frame-like member 4471 and a frame-like member 4472) described later.

Similarly, the cooling pipe 14 is applied to element cooling pipes 463 (a liquid crystal panel cooling pipe 4631R, an incidence side sheet polarizer cooling pipe 4632R, and an emission side sheet polarizer cooling pipe 4633R).

It is possible to realize a reduction in cost and a reduction in size of the projector by applying the cooling units and the manufacturing methods for the cooling units to the liquid crystal unit 46 described later. Moreover, it is possible to extend a durable life according to improvement of cooling performance.

Figure 18:
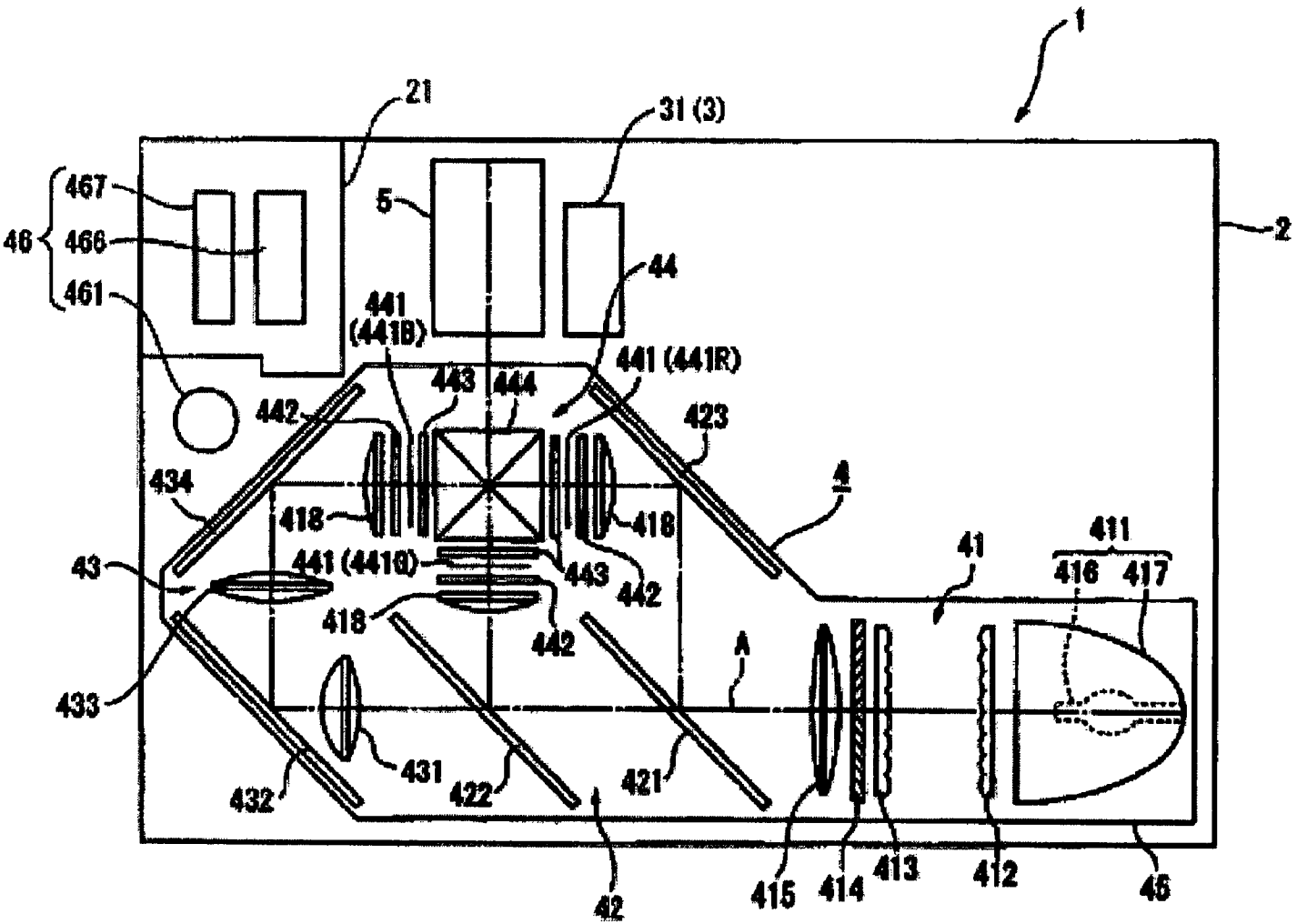
FIG. 18 is a diagram schematically showing a constitution of a projector.

FIG. 18 is a diagram schematically showing a constitution of a projector 1.

The projector 1 modulates light beams emitted from a light source according to image information to form an optical image and magnifies and projects the optical image on a screen. The projector 1 includes an armor case 2, an air cooling device 3, an optical unit 4, and a projection lens 5 serving as a projection optical device.

In FIG. 18, although not shown in the figure, it is assumed that a power supply block, a lamp driving circuit, and the like are arranged in spaces other than the air cooling device 3, the optical unit 4, and the projection lens 5 in the armor case 2.

The armor case 2 is formed of synthetic resin or the like and, as a whole, formed in a substantially rectangular parallelepiped shape in which the air cooling device 3, the optical unit 4, and the projection lens 5 are housed and arranged. Although not shown in the figure, the armor case 2 includes an upper case constituting a top surface, a front surface, a rear surfaces, and sides of the projector 1 and a lower case constituting a bottom surface, the front surface, the sides, and the rear surface of the projector 1. The upper case and the lower case are fixed to each other by screws or the like.

A material of the armor case 2 is not limited to synthetic resin. The armor case 2 may be formed of other materials such as metal.

Further, although not shown in the figure, an intake port (e.g., an intake port 22 shown in FIG. 19) for leading the air into the inside of the projector 1 from the outside and an exhaust port for discharging the air warmed in the projector 1 are formed in the armor case 2.

Moreover, as shown in FIG. 18, a partition wall 21 is also formed in the armor case 2. The partition wall 21 is located in a side direction of the projection lens 5 and a corner part of the armor case 2 and separates a radiator 466, an axial flow fan 467, and the like described later of the optical unit 4 from other members.

The air cooling device 3 is a device that feeds a cooling air into a cooling channel formed in the projector 1 and cools heat generated in the projector 1. The air cooling device 3 includes a sirocco fan 31 that is located in the side direction of the projection lens 5 and leads the cooling air on the outside of the projector 1 into the inside of the projector 1 from the not-shown intake port formed in the armor case 2, a cooling fan for cooling the power supply block, the lamp driving circuit, and the like not shown in the figure, and the like.

The optical unit 4 is a unit that optically processes light beams emitted from the light source to form an optical image (a color image) according to image information. As shown in FIG. 18, as an overall shape, the optical unit 4 has a substantially L shape that extends generally along the rear surface of the armor case 2 and extends along the sides of the armor case 2. A detailed constitution of the optical unit 4 is described later.

The projection lens 5 is constituted as a group lens in which plural lenses are combined. The projection lens 5 magnifies and projects the optical image (the color image) formed by the optical unit 4 on a not-shown screen.

Detailed Constitution of the Optical Unit

As shown in FIG. 18, the optical unit 4 includes an optical component housing 45 in which an integrator lighting optical system 41, a color separating optical system 42, a relay optical system 43, an optical device 44 are housed and arranged and the liquid cooling unit 46.

The integrator lighting optical system 41 is an optical system for substantially uniformly lighting an image forming area of a liquid crystal panel described later that constitutes the optical device 44. As shown in FIG. 18, the integrator lighting optical system 41 includes a light source unit 411, a first lens array 412, a second lens array 413, a polarization converting element 414, and a superimposing lens 415.

The light source unit 411 includes a light source lamp 416 that emits rays of a radial shape and a reflector 417 that reflects radiated light emitted from the light source lamp 416.

As the light source lamp 416, a halogen lamp, a metal halide lamp, and a high-pressure mercury lamp are often used. In FIG. 18, a radiating surface mirror is adopted as the reflector 417. However, the reflector 417 is not limited to this. The reflector 417 may be constituted by an ellipsoidal mirror and adopt, on a light beam emitting side, a paralleling concave lens that changes light beams reflected by the ellipsoidal mirror to parallel beams.

The first lens array 412 has a constitution in which small lenses having a substantially rectangular outline viewed from an optical axis direction are arranged in a matrix shape. The respective small lenses divide a light beam emitted from the light source unit 411 into plural partial light beams.

The second lens array 413 has substantially the same constitution as the first lens array 412 in which small lenses are arranged in a matrix shape. The second lens array 413 has a function of focusing images of the respective small lenses of the first lens array 412 on a liquid crystal panel described later of the optical device 44 in conjunction with the superimposing lens 415.

The polarization converting element 414 is arranged between the second lens array 413 and the superimposing lens 415 and converts light from the second lens array 413 into substantially one kind of polarized light.

Specifically, respective partial lights converted into substantially one kind of polarized light by the polarization converting element 414 are generally superimposed on the liquid crystal panel described later of the optical device 44 finally by the superimposing lens 415. In a projector using a liquid crystal panel of a type for modulating polarized light, since only one kind of polarized light can be used, substantially a half of light from the light source unit 411, which emits random polarized light, cannot be used. Therefore, emitted light from the light source unit 411 is converted into substantially one kind of polarized light by using the polarization converting element 414. Consequently, efficiency of use of light in the optical device 44 is improved.

As shown in FIG. 18, the color separating optical system 42 includes two dichroic mirrors 421 and 422 and a reflection mirror 423. The color separating optical system 42 has a function of separating plural partial light beams emitted from the integrator lighting optical system 41 into color lights of three colors, red (R), green (G), and blue (B), using the dichroic mirrors 421 and 422.

As shown in FIG. 18, the relay optical system 43 includes an incidence side lens 431, a relay lens 433, and reflection mirrors 432 and 434. The relay optical system 43 has a function of leading blue light separated by the color separating optical system 42 to a liquid crystal panel for blue light described later of the optical device 44.

In this case, the dichroic mirror 421 of the color separating optical system 42 reflects a red light component of a light beam emitted from the integrator lighting optical system 41 and transmits a green light component and a blue light component. Red light reflected by the dichroic mirror 421 is reflected by the reflection mirror 423 and passes through a field lens 418 to reach a liquid crystal panel for red light described later of the optical device 44. The field lens 418 converts respective partial light beams emitted from the second lens array 413 into light beams parallel to a center axis of the light beams (a main ray). The field lenses 418 provided on light incidence sides of the liquid crystal panels for green light and blue light function in the same manner.

In green light and blue light transmitted through the dichroic mirror 421, the green light is reflected by the dichroic mirror 422 and passes through the field lens 418 to reach the liquid crystal panel for green light described later of the optical device 44. On the other hand, the blue light is transmitted through the dichroic mirror 422 and passes through the relay optical system 43 and the field lens 418 to reach the liquid crystal panel for blue light described later of the optical device 44. The relay optical system 43 is used for the blue light in order to prevent deterioration in efficiency of use of light due to divergence or the like of light because length of an optical path of the blue light is longer than lengths of optical paths of other color lights. In other words, the relay optical system 43 is used for the blue light because an optical path length of partial color light made incident on the incidence side lens 431 is long. However, it is also conceivable to set an optical path length of the red light long.

As shown in FIG. 18, the optical device 44 is obtained by integrally constituting three liquid crystal panels 441 (a liquid crystal panel for red light is denoted by 441R, a liquid crystal panel for green light is denoted by 441G, and a liquid crystal panel for blue light is denoted by 441B) serving as optical modulation elements, three incidence side sheet polarizers 442 and three emission side sheet polarizers 443 serving as optical conversion elements arranged on light beam incidence sides and light beam emission sides of the liquid crystal panels 441, and a cross dichroic prism 444 serving as a color combining optical device.

Although not specifically shown in the figure, the liquid crystal panels 441 have a structure in which liquid crystal serving as an electro-optic material is sealed and encapsulated between a pair of transparent glass substrates. An orientation state of the liquid crystal is controlled according to a driving signal outputted from a not-shown control device. Consequently, the liquid crystal panels 441 modulate a polarization direction of polarized light beams emitted from the incidence side sheet polarizers 442.

Respective color lights, polarizing directions of which are arranged in a substantially one direction by the polarization converting element 414, are made incident on the incidence side sheet polarizers 442. The incidence side sheet polarizers 442 transmit only polarized lights in substantially the same direction as a polarization axis of the light beams arranged by the polarization converting element 414 in the light beams made incident on the incidence side sheet polarizers 442 and absorb the other light beams (a light absorption type).

Although not specifically shown in the figure, the incidence side sheet polarizers 442 have a structure in which a polarizing film is stuck on a translucent substrate of sapphire glass, liquid crystal, or the like. The polarizing film of the light absorption type is formed by, for example, uniaxially stretching a film containing iodine molecules or dye molecules. The polarizing film has an advantage that an extinction ratio is relatively high and incidence angle dependency is relatively small.

The emission side sheet polarizers 443 have substantially the same constitution as the incidence side sheet polarizers 442. The emission side sheet polarizers 443 transmit only light beams having a polarization axis orthogonal to a transmission axis of light beams in the incidence side sheet polarizers 442 in the light beams emitted from the liquid crystal panel 441 and absorb the other light beams (a light absorption type).

The cross dichroic prism 444 is an optical element that composes optical images modulated for each of color lights emitted from the emission side sheet polarizers 443 to form a color image. The cross dichroic prism 444 assumes a substantially square shape in a plan view obtained by sticking four rectangular prisms. Two dielectric multilayer films are formed on interfaces where the rectangular prisms are stuck to one another. The dielectric multilayer films reflect color lights emitted from the liquid crystal panels 441R and 441B and passing through the emission side sheet polarizers 443 and transmit color light emitted from the liquid crystal panel 441G and passing through the emission side sheet polarizer 443. In this way, the respective color lights modulated by the respective liquid crystal panels 441R, 441G, and 441B are combined to form a color image.

The optical component housing 45 is formed of, for example, a metal member. A predetermined lighting optical axis A is set inside the optical component housing 45. The optical components 41 to 44 are housed and arranged in predetermined positions relative to the lighting optical axis A. A material of the optical component housing 45 is not limited to the metal member. The optical component housing 45 may be formed of other materials. In particular, the optical component housing 45 is preferably formed of a heat conductive material.

The liquid cooling unit 46 circulates a cooling fluid to cool mainly the optical device 44. The liquid cooling unit 46 includes a fluid pumping unit, an element cooling pipe, a branching tank, a merging tank, a pipe unit, and the like described later other than a main tank 461 that temporarily stores the cooling fluid, the radiator 466 serving as a heat radiating unit for radiating heat of the cooling fluid, and the axial flow fan 467 that blows a cooling air on the radiator 466.

Figure 19:
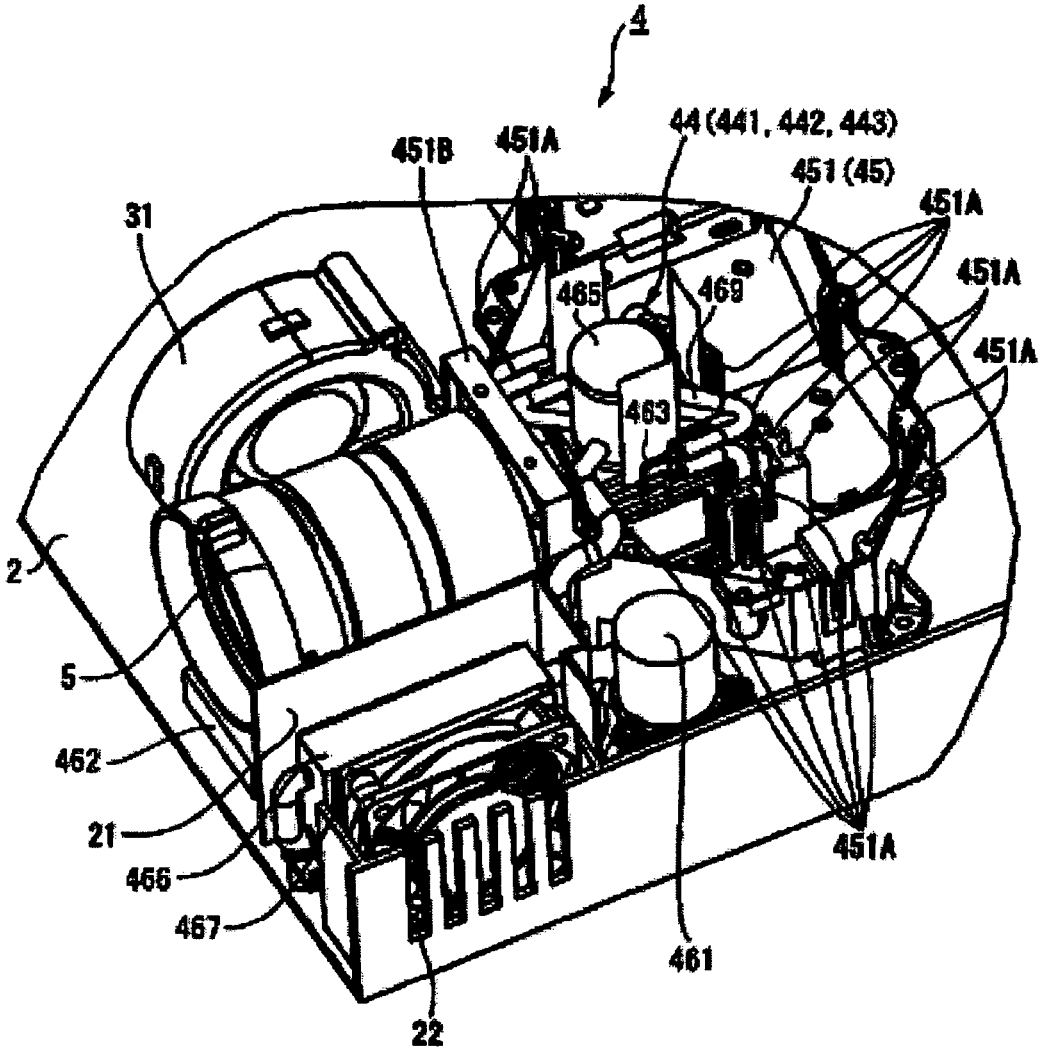
FIG. 19 is a perspective view of a part inside the projector view from an upper side thereof.

FIG. 19 is a perspective view of a part in the projector 1 viewed from an upper side thereof. FIG. 18 is a perspective view of mainly the optical device 44 and the liquid cooling unit 46 in the projector 1 viewed from below.

Figure 20:
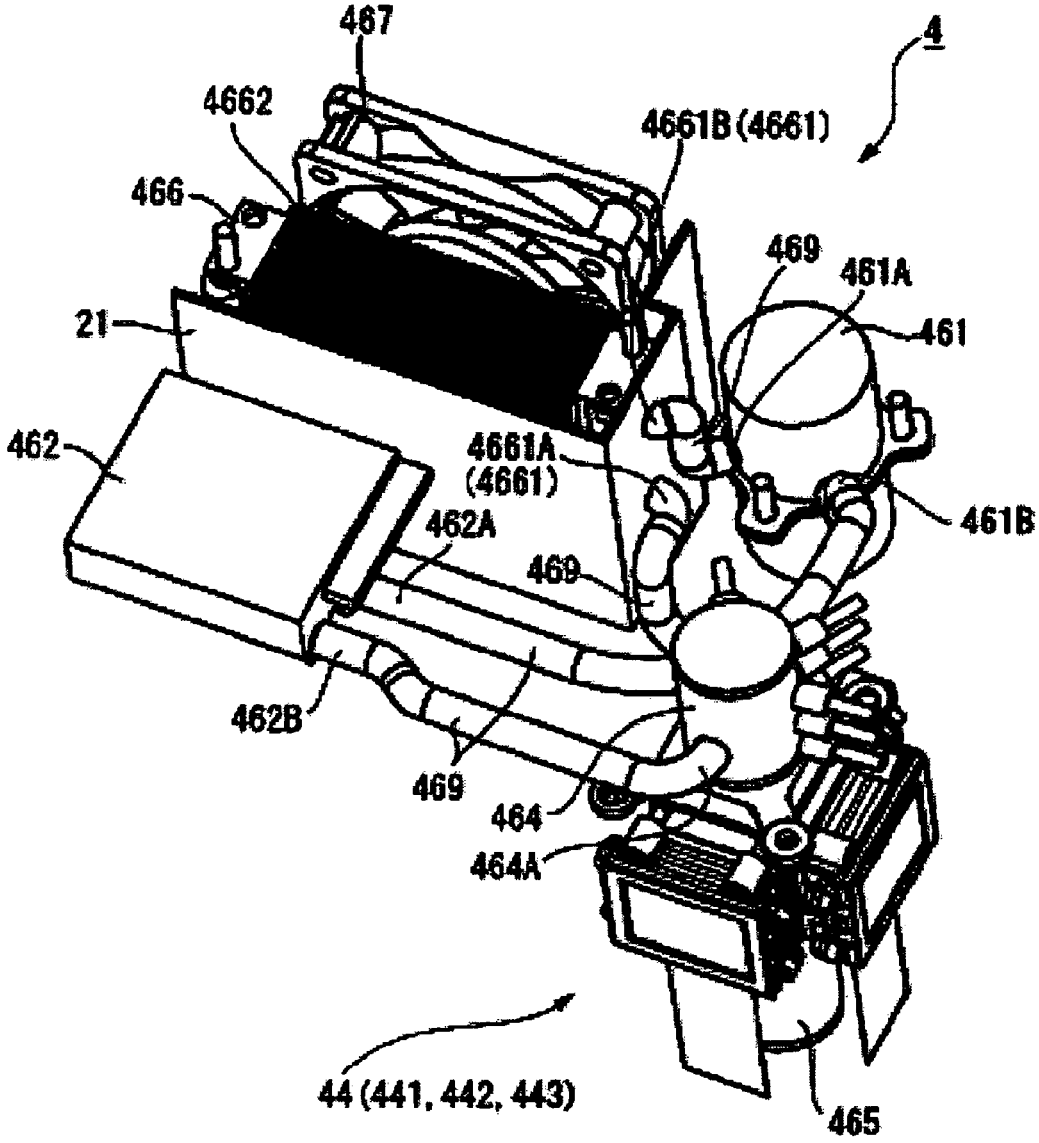
FIG. 20 is a perspective view of an optical device and a liquid cooling unit inside the projector viewed from a lower side thereof.

In FIG. 19, for simplification of explanation, only the optical device 44 is shown and the other optical components 41 to 43 in the optical component housing 45 are not shown. In FIGS. 19 and 20, for simplification of explanation, a part of members in the liquid cooling unit 46 are not shown.

As shown in FIG. 19, the optical component housing 45 includes a component housing member 451 and a not-shown cover member that closes an opening of the component housing member 451.

The component housing member 451 constitutes a bottom surface, a front surface, and sides of the optical component housing 45.

In the component housing member 451, as shown in FIG. 19, grooves 451A for fitting in the optical components 41 to 44 from above in a sliding manner are formed in inner side surfaces of the sides.

As shown in FIG. 19, a projection lens setting unit 451B for setting the projection lens 5 in a predetermined position relatively to the optical unit 4 is formed in a front surface portion of the sides. The projection lens setting unit 451B is formed in a substantially rectangular shape in a plan view. A not-shown circular hole is formed in a substantially center portion in a plan view in association with a light beam emitting position of the optical device 44. A color image formed by the optical unit 4 is magnified and projected by the projection lens 5 through the hole.

Liquid Cooling Unit

The liquid cooling unit 46 will be hereinafter explained in detail.

In FIGS. 19 and 20, the liquid cooling unit 46 includes the main tank 461, a fluid pumping unit 462 (FIG. 20), the element cooling pipes 463, a branching tank 464 (FIG. 20), a merging tank 465, a radiator 466, the axial flow fan 467, and a pipe unit 469.

As shown in FIGS. 19 and 20, the main tank 461 has a substantially cylindrical shape as a whole. The main tank 461 includes two container-like members made of metal such as aluminum. Openings of the two container-like members are connected to each other to temporarily store a cooling fluid inside the main tank 461. These container-like members are connected by, for example, seal welding or interposing an elastic member such as rubber.

As shown in FIG. 20, an inflow section 461A and an outflow section 461B for the cooling fluid are formed in a peripheral surface of the main tank 461.

The inflow section 461A and the outflow section 461B are formed of a tubular member and arranged to project to the inside and the outside of the main tank 461. One end of the pipe section 469 is connected to one end of the inflow section 461A projecting to the outer side. A cooling fluid from the outside flows into the main tank 461 via the pipe section 469. One end of the pipe section 469 is also connected to one end of the outflow section 461B projecting to the outer side. The cooling fluid in the main tank 461 flows out to the outside via the pipe section 469.

In the main tank 461, respective center axes of the inflow section 461A and the outflow section 461B are in a positional relation in which the center axes are substantially orthogonal to each other. Consequently, the cooling fluid flowing into the main tank 461 via the inflow section 461A is prevented from immediately flowing out to the outside via the outflow section 461B. Uniformalization of the cooling fluid and homogenization of temperature are realized by a mixing action inside the main tank 461. The cooling fluid flowing out from the main tank 461 is sent to the fluid pumping unit 462 via the pipe section 469.

As shown in FIG. 20, the fluid pumping unit 462 sucks the cooling fluid from the main tank 461 to the inside thereof and forcibly discharges the cooling fluid to the outside toward the branching tank 464. The outflow section 461B of the main tank 461 and the inflow section 462A of the fluid pumping unit 462 are connected via the pipe section 469. The outflow section 462B of the fluid pumping unit 462 and the inflow section 464A of the branching tank 464 are connected via the pipe section 469.

Specifically, the fluid pumping unit 462 has, for example, a constitution in which impellers are arranged in a hollow member made of metal such as aluminum of a substantially rectangular parallelepiped shape. Under the control of the not-shown control device, when the impellers rotate, the fluid pumping unit 462 forcibly sucks the cooling fluid stored in the main tank 461 via the pipe section 469 and forcibly discharges the fooling fluid to the outside via the pipe section 469. With such a constitution, it is possible to reduce a thickness dimension in a rotation axis direction of the impellers. A reduction in size and saving of space are realized. In this embodiment, as shown in FIGS. 19 and 20, the fluid pumping unit 462 is arranged below the projection lens 5.

The element cooling pipes 463 are disposed to be adjacent to the liquid crystal panels 441, the incidence side sheet polarizers 442, and the emission side sheet polarizers 443 in the optical device 44. Heat exchange is performed between the cooling fluid flowing through the element cooling pipes 463 and the respective elements 441, 442, and 443.

Figure 21:
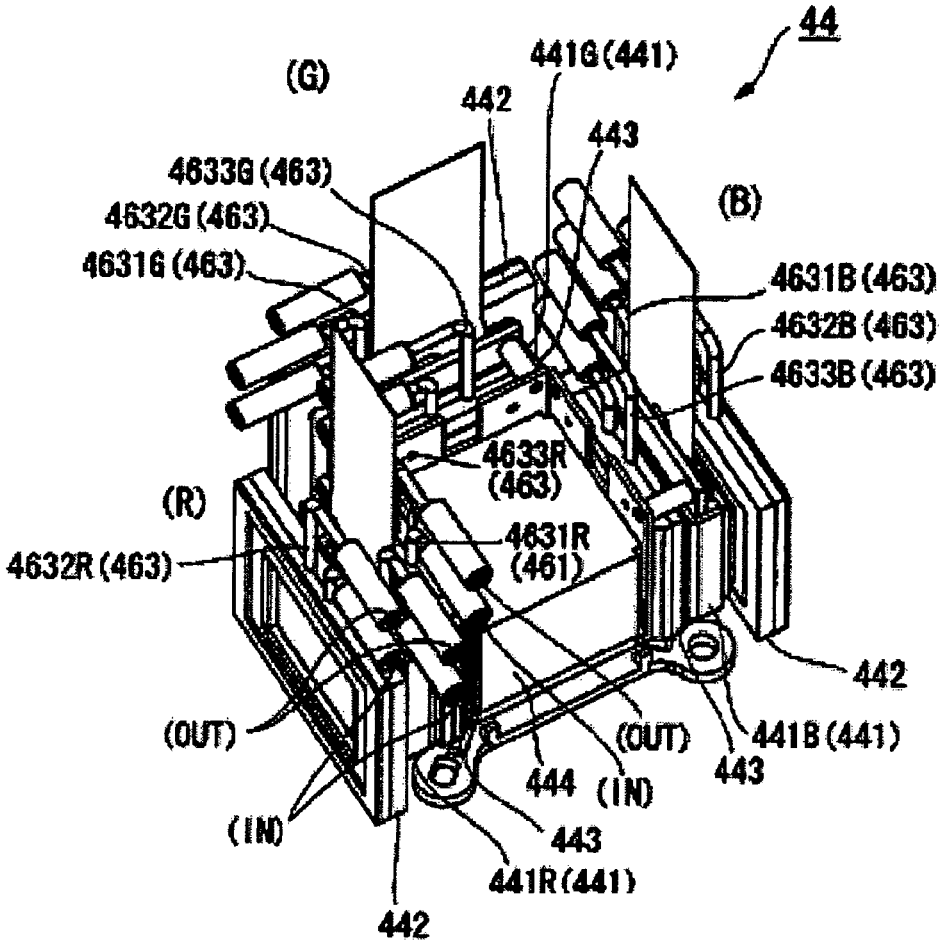
FIG. 21 is a perspective view showing an overall constitution of the optical device.

FIG. 21 is a perspective view showing an overall constitution of the optical device 44.

In FIG. 21, as described above, the optical device 44 is obtained by integrally constituting the three liquid crystal panels 441 (the liquid crystal panel for red light 441R, the liquid crystal panel for green light 441G, and the liquid crystal panel for blue light 441B), the sheet polarizers (the incidence side sheet polarizers 442 and the emission side sheet polarizers 443) arranged on the incidence sides or the emission sides of the respective liquid crystal panels 441, and the cross dichroic prism 444.

For each of the colors, red (R), green (G), and blue (B), the emission side sheet polarizers 443, the liquid crystal panels 441, and the incidence side sheet polarizers 442 are arranged to be superimposed on the cross dichroic prism 444 in this order.

The element cooling pipes 463 are disposed individually for the liquid crystal panels 441, the incidence side sheet polarizers 442, and the emission side sheet polarizers 443, respectively.

Specifically, for red light, the element cooling pipe 463 includes a liquid crystal panel cooling pipe 4631R disposed at the peripheral edge of the liquid crystal panel 441R, an incidence side sheet polarizer cooling pipe 4632R disposed at the peripheral edge of the incidence side sheet polarizer 442, and an emission side sheet polarizer cooling pipe 4633R disposed at the peripheral edge of the emission side sheet polarizer 443. The cooling fluid flows into the respective pipes from inflow sections (IN) of the respective element cooling pipes 4631R, 4632R, and 4633R, flows along the peripheral edges of the respective elements 441R, 442, and 443, and flows out to the outside from outflow sections OUT) of the respective pipes.

Similarly, for green light, the element cooling pipe 463 includes a liquid crystal panel cooling pipe 4631G disposed at the peripheral edge of the liquid crystal panel 441G, an incidence side sheet polarizer cooling pipe 4632G disposed at the peripheral edge of the incidence side sheet polarizer 442, and an emission side sheet polarizer cooling pipe 4633G disposed at the peripheral edge of the emission side sheet polarizer 443. Further, for blue light, the element cooling pipe 463 includes a liquid crystal panel cooling pipe 4631B disposed at the peripheral edge of the liquid crystal panel 441B, an incidence side sheet polarizer cooling pipe 4632B disposed at the peripheral edge of the incidence side sheet polarizer 442, and an emission side sheet polarizer cooling pipe 4633B disposed at the peripheral edge of the emission side sheet polarizer 443.

In this embodiment, peripheral edges of the respective elements, that is, the liquid crystal panels 441, the incidence side sheet polarizers 442, and the emission side sheet polarizers 443, are held by holding frames. The respective element cooling pipes 463 are disposed inside the holding frames along the peripheral edges of the respective elements. The inflow sections (IN) and the outflow sections (OUT) of the respective element cooling pipes 463 are disposed on the identical sides of the respective elements 441, 442, and 443.

Detailed structures of the element holding frames and the element cooling pipes 463 will be described later.

Referring back to FIGS. 19 and 20, the branching tank 464 branches a cooling fluid sent from the fluid pumping unit 462 to the respective element cooling pipes 463 as shown in FIG. 20.

As shown in FIG. 19, the merging tank 465 merges cooling fluids sent from the respective element cooling pipes 463 and temporarily stores the merged cooling fluids.

In this embodiment, the branching tank 464 is arranged on one surface of the cross dichroic prism 444 in the optical device 44 and the merging tank 465 is arranged on one surface on the opposite side of the cross dichroic prism 444. Arrangement positions of the branching tank 464 and the merging tank 465 are not limited to thee positions and may be other positions.

Figure 22:
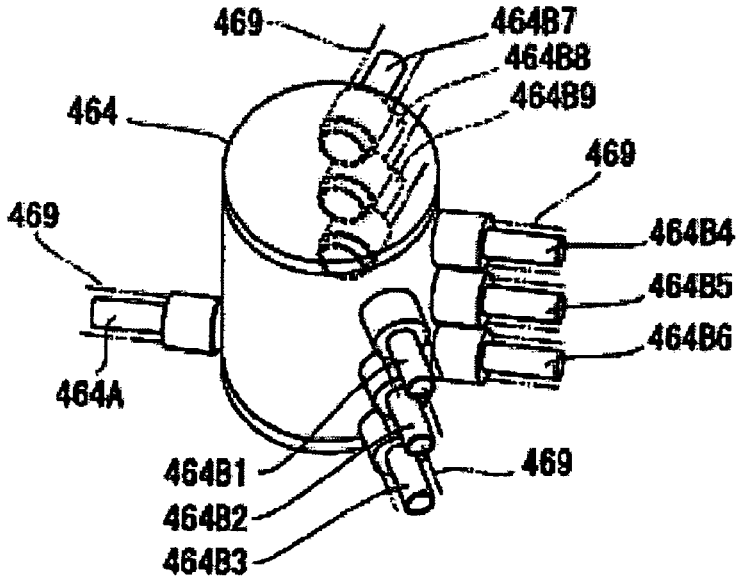
FIG. 22 is a perspective view showing an entire constitution of a branching tank.
Figure 23:
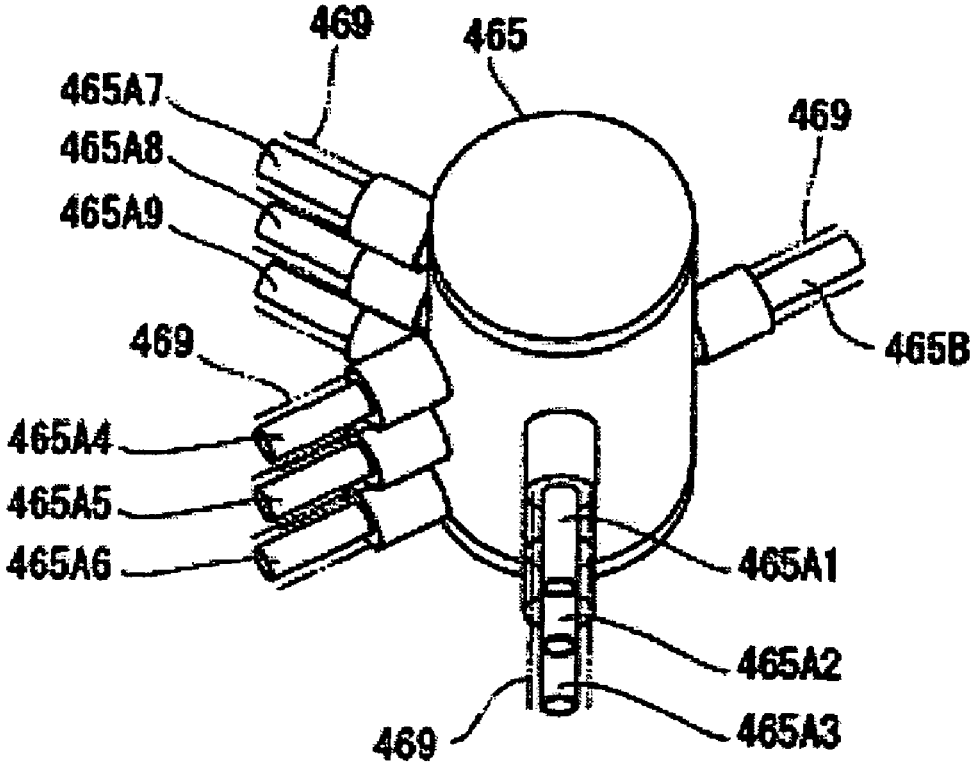
FIG. 23 is a perspective view showing an overall constitution of a merging tank.

FIG. 22 is a perspective view showing an overall constitution of the branching tank 464. FIG. 23 is a perspective view showing an overall constitution of the merging tank 465.

As shown in FIG. 22, the branching tank 464 has a substantially cylindrical shape as a whole. The branching tank 464 is formed of a sealed container-like member made of metal such as aluminum to temporarily store a cooling fluid in the inside thereof.

An inflow section 464A and outflow sections 464B1, 464B2, . . . , and 464B9 for a cooling fluid are formed on a peripheral surface of the branching tank 464.

The inflow sections 464A and the outflow sections 464B1 to 464B9 are formed of a tubular member and arranged to project to the inside and the outside of the branching tank 464. One end of the pipe section 469 is connected to one end of the inflow section 464A projecting to the outer side. A cooling fluid from the fluid pumping unit 462 (see FIG. 20) flows into the branching tank 464 via the pipe section 469. One ends of the pipe sections 469 are also individually connected respective one ends the outflow sections 464B1 to 464B9 projecting to the outer side. The cooling fluid in the branching tank 464 flows out to the respective element cooling pipes 463 (see FIG. 21) via the pipe sections 469.

As shown in FIG. 23, the merging tank 465 has a substantially cylindrical shape as a whole and is formed of a sealed container-like member made of metal such as aluminum to temporarily store a cooling fluid in the inside thereof in the same manner as the branching tank 464.

Inflow sections 465A1, 465A2, . . . , and 465A9 and an outflow section 465B for a cooling fluid are formed on a peripheral surface of the merging tank 465.

The inflow sections 465A1 to 465A9 and the outflow section 465B are formed of a tubular member and arranged to project to the inside and the outside of the merging tank 465. One ends of the pipe sections 469 are individually connected to respective one ends of the inflow sections 465A1 to 465A9 projecting to the outer side. Cooling fluids from the respective element cooling pipes 463 (see FIG. 21) flow into the merging tank 465 via the pipe sections 469. One end of the pipe section 469 is also connected to one end of the outflow section 465B projecting to the outside. The cooling fluid in the merging tank 465 flows out to the radiator 466 via the pipe section 469.

Referring back to FIGS. 19 and 20, the radiator 466 includes a tubular member 4661 through which a cooling fluid flows and plural radiation fins 4662 connected to the tubular member as shown in FIG. 20.

The tubular member 4661 is formed of a member having a high thermal conductivity such as aluminum. The cooling fluid flowing in from the inflow section 4661A flows inside the tubular member 4661 to the outflow section 4661B. The inflow section 4661A of the tubular member 4661 and the outflow section 465B of the merging tank 465 are connected via the pipe section 469. The outflow section 4661B of the tubular member 4661 and the main tank 461 are connected via the pipe 469.

The plural radiation fins 4662 are formed of a tabular member having a high thermal conductivity such as aluminum and arranged in parallel to one another. The axial flow fan 467 is constituted to blow a cooling air on the radiator 466 from one surface side of the radiator 466.

In the radiator 466, heat of the cooling fluid flowing in the tubular member 4661 is radiated via the radiation fins 4662. The heat radiation is facilitated by the supply of the cooling air by the axial flow fan 467.

As a material forming the pipe section 469, for example, metal such as aluminum is used. Other materials such as resin may be used.

As the cooling fluid, for example, ethylene glycol, which is transparent nonvolatile liquid, is used. Other fluids may be used. The cooling fluid in some aspects of the invention is not limited to liquid and may be gas. A mixture of liquid and solid and the like may be used.

As explained above, in the liquid cooling unit 46, the cooling fluid flows through the main tank 461, the fluid pumping unit 462, the branching tank 464, the element cooling pipes 463, the merging tank 465, and the radiator 466 in this order via the pipe section 469. The cooling fluid returns to the main tank 461 from the radiator 466 and flows through the path repeatedly to circulate.

In the liquid cooling unit 46, since the cooling fluid flows through the respective element cooling pipes 463, heat of the respective elements 441, 442, and 443 in the optical device 44 generated by irradiation or the like of light beams is appropriately removed. Consequently, temperature rise in the respective element 441, 442, and 443 is controlled. The heat of the respective elements 441, 442, and 443 is transmitted to the cooling fluid in the respective element cooling pipes 463 via the holding frames of the respective elements.

Element Holding Frames and Element Cooling Pipes

The element holding frames and the element cooling pipes will be explained. The element holding frame and the element cooling pipe for red light will be explained as representative ones. However, those for green light and blue light are the same.

Figure 24:
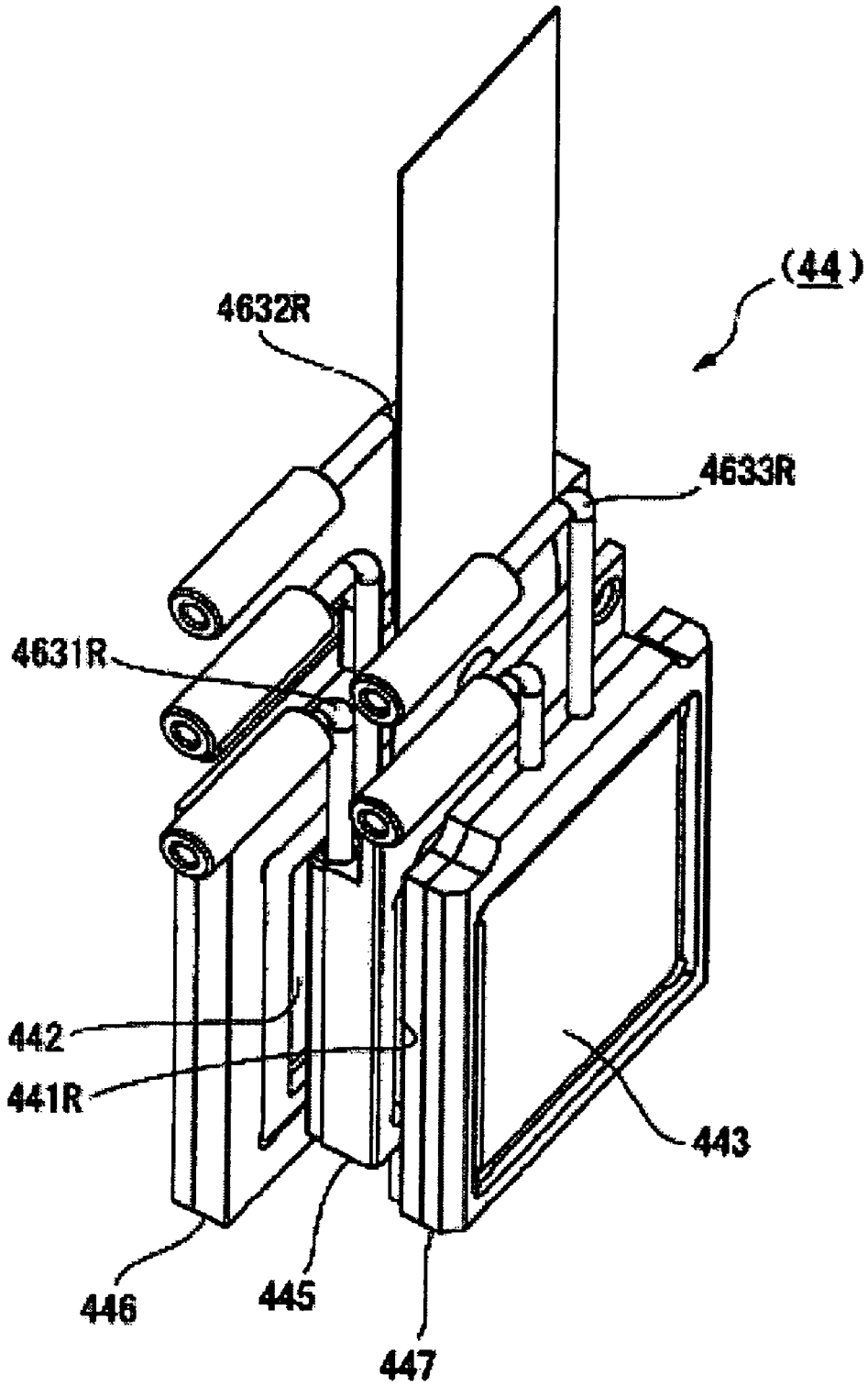
FIG. 24 is a partial perspective view showing a panel constitution for red light in the optical device.

FIG. 24 is a partial perspective view showing a panel constitution for red light in the optical device 44.

As shown in FIG. 24, for red light, the peripheral edge of the liquid crystal panel 441R is held by the liquid crystal panel holding frame 445, the peripheral edge of the incidence side sheet polarizer 442 is held by the incidence side sheet polarizer holding frame 446, and the peripheral edge of the emission side sheet polarizer 443 is held by the emission side sheet polarizer holding frame 447. The respective holding frames 445, 446, and 447 have rectangular openings described later corresponding to an image forming area of the liquid crystal panel 441R. Light beams pass through these openings.

The liquid crystal panel cooling pipe 4631R is disposed inside the liquid crystal panel holding frame 445 along the peripheral edge of the liquid crystal panel 441R. The incidence side sheet polarizer cooling pipe 4632R is disposed inside the incidence side sheet polarizer holding frame 446 along the peripheral edge of the incidence side sheet polarizer 442. The emission side sheet polarizer cooling pipe 4633R is disposed inside the emission side sheet polarizer holding frame 447 along the peripheral edge of the emission side sheet polarizer 443.

Figure 25:
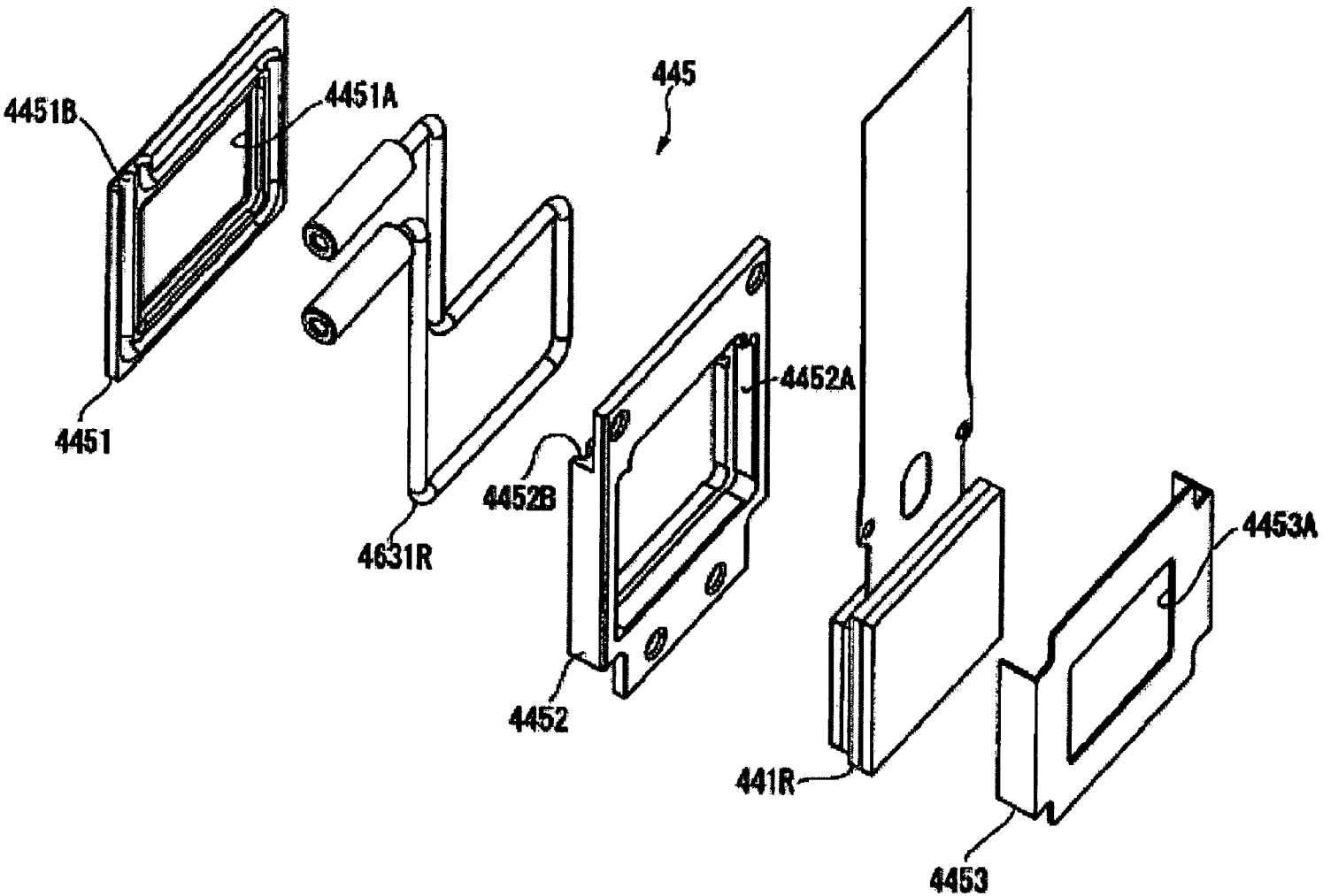
FIG. 25 is a disassembled perspective view of a liquid crystal panel holding frame.
Figure 26A:
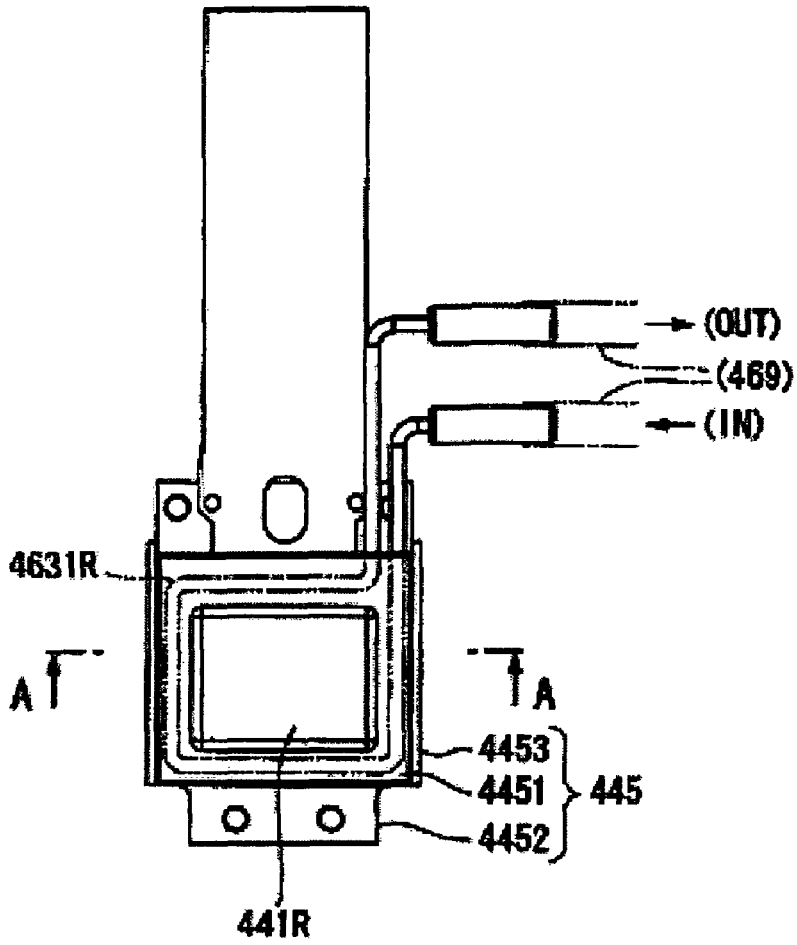
FIG. 26A is an assembled front view of the liquid crystal panel holding frame.
Figure 26B:
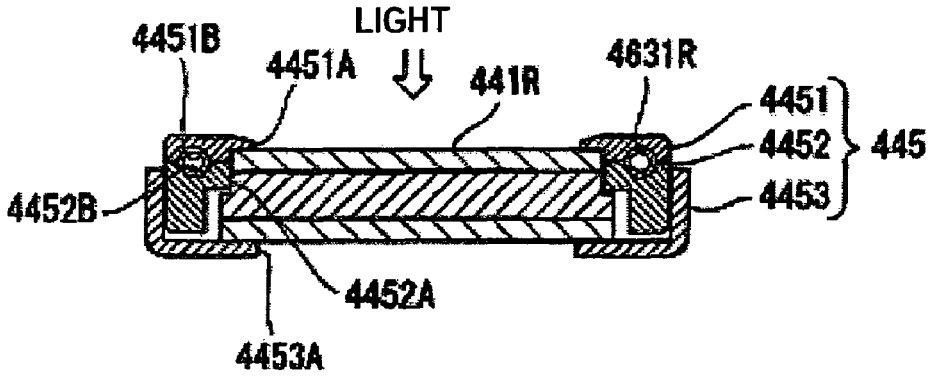
FIG. 26B is a sectional view along line A-A in FIG. 26A.

FIG. 25 is a disassembled perspective view of the liquid crystal panel holding frame 445. FIG. 26A is an assembled front view of the liquid crystal panel holding frame 445 and FIG. 26B is a sectional view along line A-A in FIG. 26A.

As shown in FIG. 25, the liquid crystal panel holding frame 445 includes a pair of frame-like members 4451 and 4452 and a liquid crystal panel fixing plate 4453.

The liquid crystal panel 441R is a transmission type and has a constitution in which a liquid crystal layer is sealed and encapsulated between a pair of transparent substrates. The pair of substrates include a data line for applying a driving voltage to liquid crystal, a scanning line, a switching element, a driving substrate on which a pixel electrode and the like are formed, and an opposed substrate on which a common electrode, a black matrix, and the like are formed.

The frame-like members 4451 and 4452 are frames of a substantially rectangular shape in a plan view. The frame-like members 4451 and 4452 include rectangular openings 4451A and 4452A corresponding to the image forming area of the liquid crystal panel 441R and grooves 4451B and 4452B for housing the liquid crystal panel cooling pipe 4631R. The frame-like member 4451 and the frame-like member 4452 are arranged to be opposed to each other across the liquid crystal panel cooling pipe 4631R. As the frame-like members 4451 and 4452, a thermal good conductor made of a material having a high thermal conductivity is preferably used. For example, various kinds of metal are adopted other than aluminum (234 W/(m·K)), magnesium (156 W/(m·K)), and alloys of aluminum and magnesium (an aluminum die cast alloy (about 100 W/(m·K)), an Mg—Al—Zn alloy (about 50 W/(m·K)), etc.) A material of the frame-like members 4451 ad 4452 is not limited to a metal material and may be other materials (a resin material, etc.) having a high thermal conductivity (e.g., equal to or higher than 5 W/(m·K)).

As shown in FIG. 25, the liquid crystal panel fixing plate 4453 is formed of a tabular member having a rectangular opening 4453A corresponding to the image forming area of the liquid crystal panel 441R. The liquid crystal panel fixing plate 4453 is fixed to the frame-like member 4452 with the liquid crystal panel 441R sandwiched between the liquid crystal panel fixing plate 4453 and the frame-like member 4452. As shown in FIG. 26B, the liquid crystal panel fixing plate 4453 is arranged to be in contact with the liquid crystal panel 441R. The liquid crystal panel fixing plate 4453 has a function of bringing the frame-like members 4451 and 4452 and the liquid crystal panel 441R into close contact with each other and thermally connecting the same and a function of radiating heat of the liquid crystal panel 441R. A part of heat of the liquid crystal panel 441R is transmitted to the frame-like members 4451 and 4452 via the liquid crystal panel fixing plate 4453.

The liquid crystal panel cooling pipe 4631R is made of, for example, a pipe or a tube that has an annular section and extends along a center axis of the section. As shown in FIG. 25, the liquid crystal panel cooling pipe 4631R is bent according to a shape of the grooves 4451B and 4452B of the frame-like members 4451 and 4452. As the liquid crystal panel cooling pipe 4631R, a thermal good conductor made of a material having a high thermal conductivity is preferably used. For example, various kinds of metal are adopted other than aluminum, copper, stainless steel, and alloys of aluminum, copper, or stainless steel. A material of the liquid crystal panel cooling pipe 4631R is not limited to a metal material and may be other materials (a resin material, etc.) having a high thermal conductivity (e.g., equal to or higher than 5 W/(m·K)).

Specifically, as shown in FIGS. 26A and 26B, the liquid crystal panel cooling pipe 4631R is disposed on the outer side of the peripheral edge of the liquid crystal panel 441R along substantially the entire peripheral edge of the liquid crystal panel 441R. In the respective inner surfaces (mating surfaces, opposed surfaces) of the frame-like members 4451 and 4452, the grooves 4451B and 4452B having a substantially semicircular shape in section are formed along substantially the entire edges of the openings 4451A and 4452A. The groove 4451B and the groove 4452B are in a substantially mirror symmetrical shape relation with each other. The frame-like members 4451 and 4452 are joined with each other in a state in which the liquid crystal panel cooling pipe 4631R is housed in the grooves 4451B and 4452B. In this embodiment, the liquid crystal panel cooling pipe 4631R is a circular pipe and an outer diameter thereof is substantially the same as thickness of the liquid crystal panel 441R.

As the joining of the frame-like member 4451 and the frame-like member 4452, various methods such as fastening by screws or the like, bonding, welding, and mechanical joining such as fitting are adoptable. As a joining method, a method with a high heat transfer property between the liquid crystal panel cooling pipe 4631R and the frame-like members 4451 and 4452 (or the liquid crystal panel 441R) is preferably used.

An inflow section (IN) for a cooling fluid is disposed at one end of the liquid crystal panel cooling pipe 4631R and an outflow section (OUT) is disposed at the other end thereof. The inflow section and the outflow section of the liquid crystal panel cooling pipe 4631R are connected to the piping for cooling fluid circulation (the pipe section 469).

The cooling fluid flowing into the liquid crystal panel cooling pipe 4631R from the inflow section (IN) flows along substantially the entire peripheral edge of the liquid crystal panel 441R and flows out from the outflow section (OUT). The cooling fluid deprives the liquid crystal panel 441R of heat while flowing through the liquid crystal panel cooling pipe 4631R. In other words, the heat of the liquid crystal panel 441R is transmitted to the cooling fluid in the liquid crystal panel cooling pipe 4631R via the frame-like members 4451 and 4452 and carried to the outside.

In the liquid crystal panel holding frame 445, as shown in FIG. 26B, the liquid crystal panel cooling pipe 4631R is disposed to be close to a light beam incidence surface side of the liquid crystal panel 441R in a thickness direction of the liquid crystal panel 441R. In the liquid crystal panel 441R, in general, heat absorption is large on an incidence surface side where black matrixes are arranged compared with an emission surfaced side. Therefore, the liquid crystal panel cooling pipe 4631R is disposed to be close to the incidence surface side where temperature tends to rise. Consequently, heat of the liquid crystal panel 441R is effectively removed.

Moreover, since a step is provided on the side of the liquid crystal panel 441R, an area of the emission surface is large compared with that of the incidence surface. Therefore, the liquid crystal panel cooling pipe 4631R is disposed to be close to the incidence surface side having a small area. Consequently, efficiency of arrangement of the components and a reduction in size of the apparatus are realized.

Figure 27A:
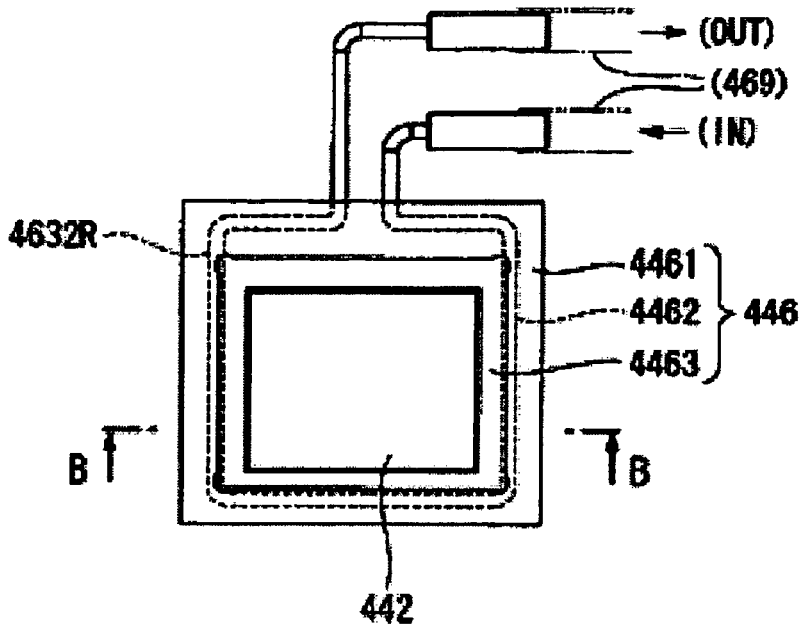
FIG. 27A is an assembled front view of an incidence side sheet polarizer holding frame.
Figure 27B:
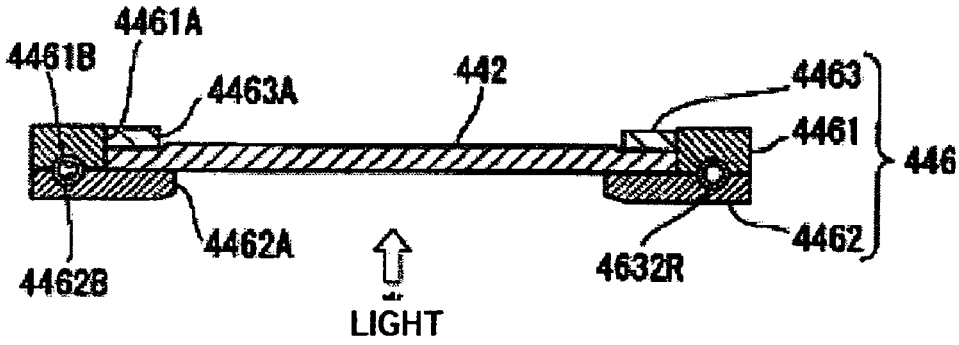
FIG. 27B is a sectional view along line B-B in FIG. 27A.

FIG. 27A is an assembled front view of the incidence side sheet polarizer holding frame 446 and FIG. 27B is a sectional view along B-B in FIG. 27A.

The incidence side sheet polarizer holding frame 446 has generally the same constitution as the liquid crystal panel holding frame 445 (see FIG. 25). As shown in FIGS. 27A and 27B, the incidence side sheet polarizer holding frame 446 includes a pair of frame-like members 4461 and 4462 and a sheet polarizer fixing plate 4463.

The incidence side sheet polarizer 442 has a structure in which a polarizing film is stuck on a translucent substrate.

The frame-like members 4461 and 4462 are frames of a substantially rectangular shape in a plan view. The frame-like members 4461 and 4462 include rectangular openings 4461A and 4462A corresponding to a light transmitting area of the incidence side sheet polarizer 442 and grooves 4461B and 4462B for housing the incidence side sheet polarizer cooling pipe 4632R. The frame-like member 4461 and the frame-like member 4462 are arranged to be opposed to each other across the incidence side sheet polarizer cooling pipe 4632R. As the frame-like members 4461 and 4462, a thermal good conductor made of a material having a high thermal conductivity is preferably used. For example, various kinds of metal are adopted other than aluminum, magnesium, and alloys of aluminum and magnesium. A material of the frame-like members 4461 and 4462 is not limited to a metal material and may be other materials (a resin material, etc.) having a high thermal conductivity (e.g., equal to or higher than 5 W/(m·K) ).

As shown in FIGS. 27A and 27B, the sheet polarizer fixing plate 4463 is made of a tabular member having a rectangular opening 4463A corresponding to the light transmitting area of the incidence side sheet polarizer 442. The sheet polarizer fixing plate 4463 is fixed to the frame-like member 4461 with the incidence side sheet polarizer 442 sandwiched between the sheet polarizer fixing plate 4463 and the frame-like member 4461. As shown in FIG. 27B, the sheet polarizer fixing plate 4463 is arranged to be in contact with the incidence side sheet polarizer 442. The sheet polarizer fixing plate 4463 has a function of bringing the frame-like members 4461 and 4462 and the incidence side sheet polarizer 442 into close contact with each other and thermally connecting the same and a function of radiating heat of the incidence side sheet polarizer 442. A part of the heat of the incidence side sheet polarizer 442 is transmitted to the frame-like members 4461 and 4462 via the sheet polarizer fixing plate 4463.

The incidence side sheet polarizer cooling pipe 4632R is made of a seamless pipe formed by drawing or the like. The incidence side sheet polarizer cooling pipe 4632R is bent according to a shape of the grooves 4461B and 4462B of the frame-like members 4461 and 4462. As the incidence side sheet polarizer cooling pipe 4632R, a thermal good conductor made of a material having a high thermal conductivity is preferably used. For example, various kinds of metal is adopted other than aluminum, copper, stainless steel, and alloys of aluminum, copper, and stainless steel. A material of the incidence side sheet polarizer cooling pipe 4632R is not limited to a metal material and may be other materials (a resin material, etc.) having a high thermal conductivity (e.g., equal to or higher than 5 W/(m·K)).

Specifically, as shown in FIGS. 27A and 27B, the incidence side sheet polarizer cooling pipe 4632R is disposed on the outer side of the peripheral edge of the incidence side sheet polarizer 442 and along substantially the entire peripheral edge of the incidence side sheet polarizer 442. In the respective inner surfaces (mating surfaces, opposed surfaces) of the frame-like members 4461 and 4462, the grooves 4461B and 4462B having a substantially semicircular shape in section are formed along substantially the entire edges of the openings 4461A and 4462A. The groove 4461B and the groove 4462B are in a substantially mirror symmetrical shape relation with each other. The frame-like members 4461 and 4462 are joined with each other in a state in which the incidence side sheet polarizer cooling pipe 4632R is housed in the grooves 4461B and 4462B. In this embodiment, the incidence side sheet polarizer cooling pipe 4632R is a circular pipe and an outer diameter thereof is substantially the same as thickness of the incidence side sheet polarizer 442.

As the joining of the frame-like member 4461 and the frame-like member 4462, various methods such as fastening by screws or the like, bonding, welding, and mechanical joining such as fitting are adoptable. As a joining method, a method with a high heat transfer property between the incidence side sheet polarizer cooling pipe 4632R and the frame-like members 4461 and 4462 (or the incidence side sheet polarizer 442) is preferably used.

An inflow section (IN) for a cooling fluid is disposed at one end of the incidence side sheet polarizer cooling pipe 4632R and an outflow section (OUT) is disposed at the other end thereof. The inflow section and the outflow section of the incidence side sheet polarizer cooling pipe 4632R are connected to the piping for cooling fluid circulation (the pipe section 469).

The cooling fluid flowing into the incidence side sheet polarizer cooling pipe 4632R from the inflow section (IN) flows along substantially the entire peripheral edge of the incidence side sheet polarizer 442 and flows out from the outflow section (OUT). The cooling fluid deprives the incidence side sheet polarizer 442 of heat while flowing through the incidence side sheet polarizer cooling pipe 4632R. In other words, the heat of the incidence side sheet polarizer 442 is transmitted to the cooling fluid in the incidence side sheet polarizer cooling pipe 4632R via the frame-like members 4461 and 4462 and carried to the outside.

Figure 28A:
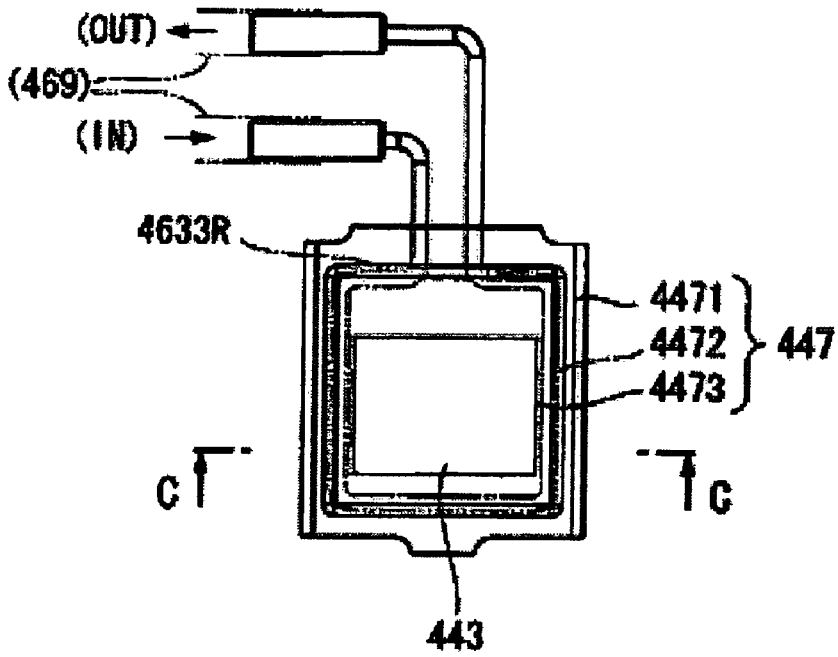
FIG. 28A is an assembled front view of an emission side sheet polarizer holding frame.
Figure 28B:
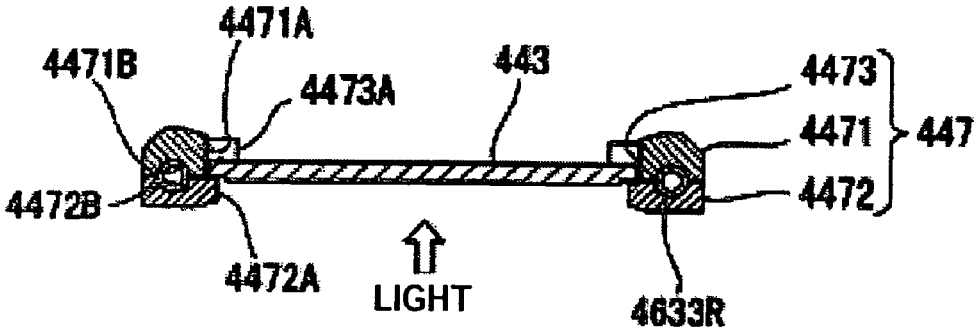
FIG. 28B is a sectional view along line C-C in FIG. 28A.

FIG. 28A is an assembled front view of the emission side sheet polarizer holding frame 447 and FIG. 28B is a sectional view along C-C in FIG. 28A.

The emission side sheet polarizer holding frame 447 has the same constitution as the incidence side sheet polarizer holding frame 446 (see FIG. 10). As shown in FIGS. 28A and 28B, the emission side sheet polarizer holding frame 447 includes a pair of frame-like members 4471 and 4472 and a sheet polarizer fixing plate 4473.

Like the incidence side sheet polarizer 442, the emission side sheet polarizer 443 has a structure in which a polarizing film is stuck on a translucent substrate.

The frame-like members 4471 and 4472 are frames of a substantially rectangular shape in a plan view. The frame-like members 4471 and 4472 include rectangular openings 4471A and 4472A corresponding to a light transmitting area of the emission side sheet polarizer 443 and grooves 4471B and 4472B for housing the emission side sheet polarizer cooling pipe 4633R. The frame-like member 4471 and the frame-like member 4472 are arranged to be opposed to each other across the emission side sheet polarizer cooling pipe 4633R. As the frame-like members 4471 and 4472, a thermal good conductor made of a material having a high thermal conductivity is preferably used. For example, various kinds of metal are adopted other than aluminum, magnesium, and alloys of aluminum and magnesium. A material of the frame-like members 4471 and 4472 is not limited to a metal material and may be other materials (a resin material, etc.) having a high thermal conductivity (e.g., equal to or higher than 5 W/(m·K)).

As shown in FIGS. 28A and 28B, the sheet polarizer fixing plate 4473 is made of a tabular member having a rectangular opening 4473A corresponding to the light transmitting area of the emission side sheet polarizer 443. The sheet polarizer fixing plate 4473 is fixed to the frame-like member 4471 with the emission side sheet polarizer 443 sandwiched between the sheet polarizer fixing plate 4473 and the frame-like member 4471. As shown in FIG. 28B, the sheet polarizer fixing plate 4473 is arranged to be in contact with the emission side sheet polarizer 443. The sheet polarizer fixing plate 4473 has a function of bringing the frame-like members 4471 and 4472 and the emission side sheet polarizer 443 into close contact with each other and thermally connecting the same and a function of radiating heat of the emission side sheet polarizer 443. A part of the heat of the emission side sheet polarizer 443 is transmitted to the frame-like members 4471 and 4472 via the sheet polarizer fixing plate 4473.

The emission side sheet polarizer cooling pipe 4633R is made of a seamless pipe formed by drawing or the like. The emission side sheet polarizer cooling pipe 4633R is bent according to a shape of the grooves 4471B and 4472B of the frame-like members 4471 and 4472. As the emission side sheet polarizer cooling pipe 4633R, a thermal good conductor made of a material having a high thermal conductivity is preferably used. For example, various kinds of metal is adopted other than aluminum, copper, stainless steel, and alloys of aluminum, copper, and stainless steel. A material of the emission side sheet polarizer cooling pipe 4633R is not limited to a metal material and may be other materials (a resin material, etc.) having a high thermal conductivity (e.g., equal to or higher than 5 W/(m·K)).

Specifically, as shown in FIGS. 28A and 28B, the emission side sheet polarizer cooling pipe 4633R is disposed on the outer side of the peripheral edge of the emission side sheet polarizer 443 and along substantially the entire peripheral edge of the emission side sheet polarizer 443. In the respective inner surfaces (mating surfaces, opposed surfaces) of the frame-like members 4471 and 4472, the grooves 4471B and 4472B having a substantially semicircular shape in section are formed along substantially the entire edges of the openings 4471A and 4472A. The groove 4471B and the groove 4472B are in a substantially mirror symmetrical shape relation with each other. The frame-like members 4471 and 4472 are joined with each other in a state in which the emission side sheet polarizer cooling pipe 4633R is housed in the grooves 4471B and 4472B. In this embodiment, the emission side sheet polarizer cooling pipe 4633R is a circular pipe and an outer diameter thereof is substantially the same as thickness of the emission side sheet polarizer 443.

As the joining of the frame-like member 4471 and the frame-like member 4472, various methods such as fastening by screws or the like, bonding, welding, and mechanical joining such as fitting are adoptable. As a joining method, a method with a high heat transfer property between the emission side sheet polarizer cooling pipe 4633R and the frame-like members 4471 and 4472 (or the emission side sheet polarizer 443) is preferably used.

An inflow section (IN) for a cooling fluid is disposed at one end of the emission side sheet polarizer cooling pipe 4633R and an outflow section (OUT) is disposed at the other end thereof. The inflow section and the outflow section of the emission side sheet polarizer cooling pipe 4633R are connected to the piping for cooling fluid circulation (the pipe section 469).

The cooling fluid flowing into the emission side sheet polarizer cooling pipe 4633R from the inflow section (IN) flows along substantially the entire peripheral edge of the emission side sheet polarizer 443 and flows out from the outflow section (OUT). The cooling fluid deprives the emission side sheet polarizer 443 of heat while flowing through the emission side sheet polarizer cooling pipe 4633R. In other words, the heat of the emission side sheet polarizer 443 is transmitted to the cooling fluid in the emission side sheet polarizer cooling pipe 4633R via the frame-like members 4471 and 4472 and carried to the outside.

As described above, in this embodiment, for red light, the element cooling pipes 4631R, 4632R, and 4633R are disposed inside the holding frames 445, 446, and 447 of the respective elements, namely, the liquid crystal panel 441R, the incidence side sheet polarizer 442, and the emission side sheet polarizer 443. Heat of the respective elements 441R, 442R, and 443R is appropriately removed by a cooling fluid flowing through the element cooling pipes 4631R, 4632R, and 4633R. The respective elements 441R, 442, and 443 and the element cooling pipes 4631R, 4632R, and 4633R are thermally connected via the respective holding frames 445, 446, and 447. Heat exchange is performed between the respective elements 441R, 442, and 443 and the cooling fluid in the element cooling pipes 4631R, 4632R, and 4633R. Consequently, heat of the respective elements 441R, 442, and 443 is transmitted to the cooling fluid in the element cooling pipes 4631R, 4632R, and 4633R via the holding frames 445, 446, and 447. Since the heat of the respective elements 441R, 442, and 443 moves to the cooling fluid, the respective elements 441R, 442, and 443 are cooled.

In this embodiment, the respective element cooling pipes 4631R, 4632R, and 4633R are disposed along substantially the entire peripheral edges of the respective elements 441R,

442, and 443. Thus, expansion of a heat transfer area is realized to efficiently cool the respective elements.

Moreover, since the channels (the element cooling pipes 4631R, 4632R, and 4633R) for a cooling fluid are disposed along the peripheral edges of the respective elements 441R, 442, and 443, light beams for image formation do not pass through the cooling fluid. Therefore, images of bubbles, dust, and the like in the cooling fluid are prevented from being included in an optical image formed on the liquid crystal panel 441R. Fluctuation in the optical image due to a temperature distribution of the cooling fluid is prevented from occurring.

In this embodiment, the paths for a cooling fluid at the peripheral edges of the respective elements 441R, 442, and 443 are formed by the channels (the element cooling pipes 4631R, 4632R, and 4633R). Thus, only a relatively small joining portion is required for formation of the channels. Since the number or an area of the joining portion is small, simplification of a constitution is realized and leakage of the cooling fluid is prevented.

As described above, according to this embodiment, it is possible to effectively control a temperature rise of the respective elements 441R, 442, and 443 while controlling occurrence of deficiencies due to the use of a cooling fluid.

In the structure in which the element cooling pipes 4631R, 4632R, and 4633R are disposed inside the element holding frames 445, 446, and 447, the holding frames 445, 446, and 447 function as both holding means and cooling means for the respective elements 441R, 442, and 443. As a result, a reduction in size of the structure is easily realized. The structure is preferably applicable to a small optical element.

For example, in this embodiment, the element cooling pipes 4631R, 4632R, and 4633R having an outer diameter substantially the same as thickness of the respective elements 441R, 442, and 443 are disposed on the outer side of the peripheral edges of the respective elements. Thus, expansion in a thickness direction due to inclusion of the cooling fluid channels is controlled.

The panel constitution for red light and the cooling structure therefor in the optical device 44 (see FIG. 21) have been explained as the representative panel constitution and cooling structure. However, the panel constitution and the cooling structure are the same for green light and blue light. For green light and blue light, respective elements (a liquid crystal panel, an incidence side sheet polarizer, and an emission side sheet polarizer) are individually held in holding frames and element cooling pipes are disposed inside the holding frames.

In this embodiment, nine optical elements in total including the three liquid crystal panels 441R, 441G, and 441B, the three incidence side sheet polarizers 442, and the three emission side sheet polarizers 443 are individually cooled using a cooling fluid. Since the respective elements are individually cooled, occurrence of deficiencies due to a temperature rise in the respective elements is surely prevented.

Piping System

Figure 29:
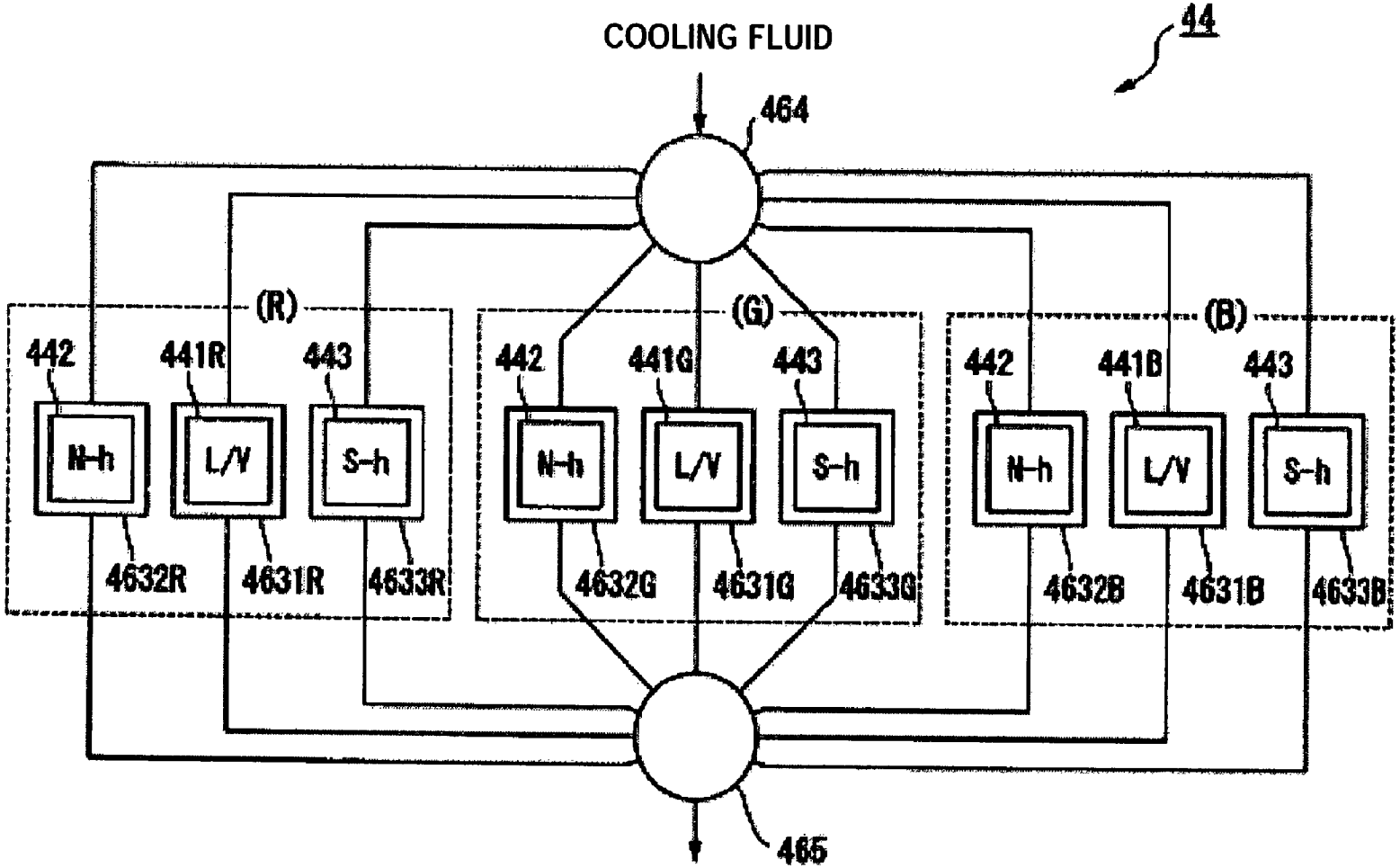
FIG. 29 is a piping system diagram showing a flow of a cooling fluid in the optical device.

FIG. 29 is a piping system diagram showing a flow of a cooling fluid in the optical device 44.

As shown in FIG. 29, in this embodiment, channels for a cooling fluid are provided parallel to the nine optical elements in total including the three liquid crystal panels 441R, 441G, and 441B, the three incidence side sheet polarizers 442, and the three emission side sheet polarizers 443 in the optical device 44.

Specifically, the three element cooling pipes including the liquid crystal panel cooling pipe 4631R, the incidence side sheet polarizer cooling pipe 4632R, and the emission side sheet polarizer cooling pipe 4633R for red light are connected to the branching tank 464 at one ends and connected to the merging tank 465 at the other ends, respectively. Similarly, the three element cooling pipes 4631G, 4632G, and 4633G for green light and the three element cooling pipes 4631B, 4632B, and 4633B for blue light are also connected to the branching tank 464 at one ends and connected to the merging tank 465 at the other ends, respectively. As a result, the nine element cooling pipes are arranged in parallel to one another on the channels for the cooling fluid between the branching tank 464 and the merging tank 465.

The cooling fluid is branched to the nine channels in total by the branching tank 464, three for each of the colors, and the branched cooling fluids flow through the nine element cooling pipes (4631R, 4632R, 4633R, 4631G, 4632G, 4633G, 4631B, 4632B, and 4633B) in parallel to one another. Since the nine element cooling pipes are arranged in parallel to one another on the channels for the cooling fluid, cooling fluids having substantially the same temperatures flow into the respective element cooling pipes. Since the cooling fluids flow through the respective element cooling pipes along the peripheral edges of the respective elements, the respective elements are cooled and temperature of the cooling fluids flowing through the respective element cooling pipes rises. After the heat exchange, the cooling fluids merge in the merging tank 465 and cooled according to heat radiation in the radiator 466 (see FIG. 20) explained above. The cooling fluid having lowered temperature is supplied to the branching tank 464 again.

In this embodiment, the nine element cooling pipes corresponding to the nine optical elements are arranged in parallel to one another on the channels for a cooling fluid. Thus, the channels for the cooling fluid from the branching tank 464 to the merging tank 465 are relatively short and a channel resistance due to a pressure loss on the channels is small. Therefore, even if the respective element cooling pipes have small diameters, it is easy to secure a flow rate of the cooling fluid. Further, since a cooling fluid with a relatively low temperature is supplied to each of the elements, the respective elements are effectively cooled.

The element cooling pipe does not have to be disposed for an element having less heat generation among the nine optical elements. For example, when the incidence side sheet polarizer 442 or the emission side sheet polarizer 443 are in a form with less absorption of light beams like an inorganic sheet polarizer, a cooling pipe does not have to be provided for the sheet polarizer.

All the plural element cooling pipes do not have to be arranged in parallel to one another on channels for a cooling fluid. At least apart of the element cooling pipes may be arranged in series. In this case, it is advisable to set the channels according to amounts of heat generation of the respective elements.

Figure 30:
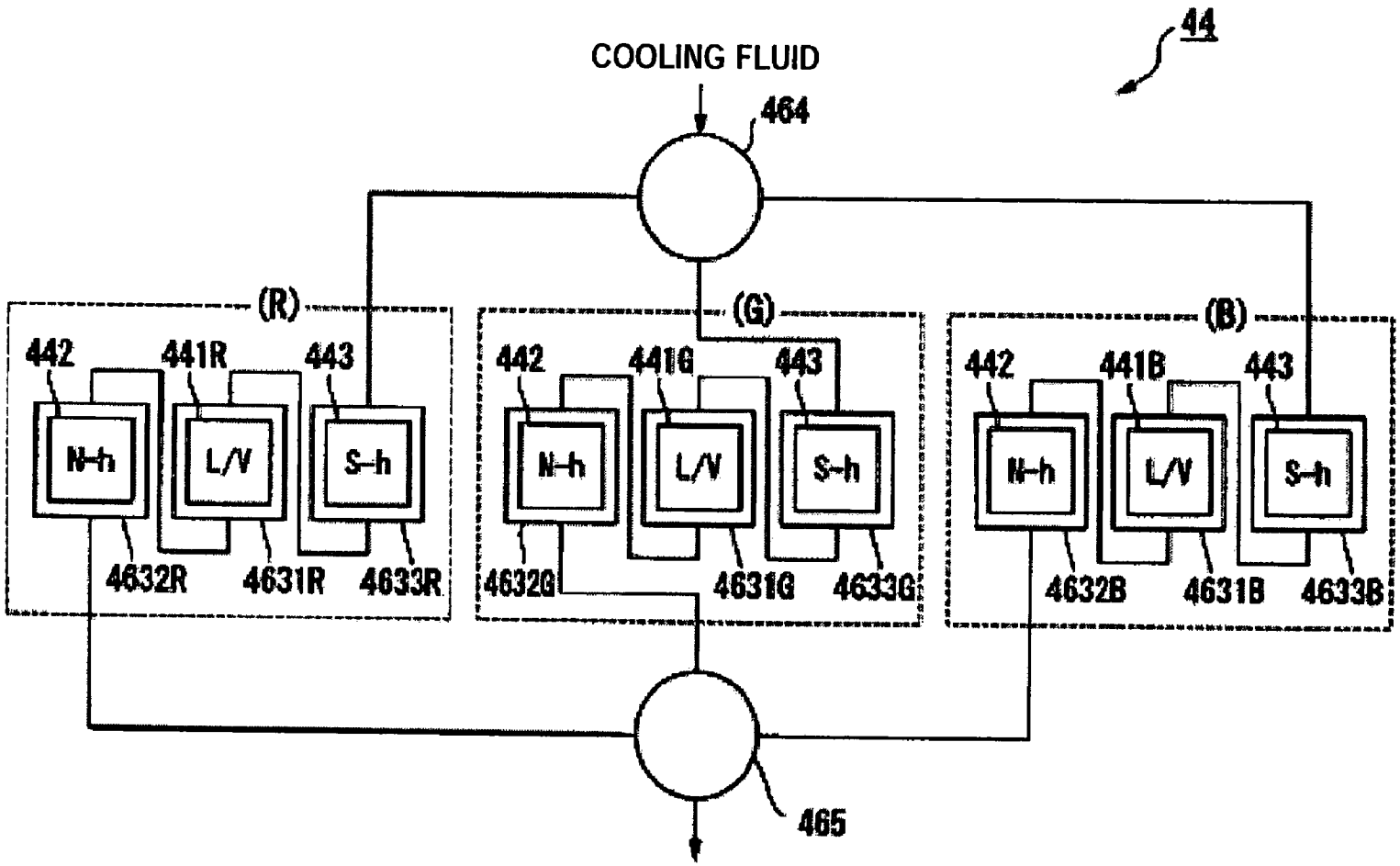
FIG. 30 is a diagram showing a modification of the piping system.

FIG. 30 shows a modification of the piping system. Components same as those in FIG. 29 are denoted by the identical reference numerals and signs.

In an example in FIG. 29, the element cooling pipes (4631R, 4632R, 4633R, 4631G, 4632G, 4633G, 4631B, 4632B, and 4633B) are disposed for the nine optical elements in total including the three liquid crystal panels 441R, 441G, and 441B, the three incidence side sheet polarizers 442, and the three emission side sheet polarizers 443 in the optical device 44. Channels for a cooling fluid are provided in series for each of the colors.

Specifically, for red light, the outflow section of the branching tank 464 and the inflow section of the emission side sheet polarizer cooling pipe 4633R are connected, the outflow section of the emission side sheet polarizer cooling pipe 4633R and the inflow section of the liquid crystal panel cooling pipe 4631R are connected, the outflow section of the liquid crystal panel cooling pipe 4631R and the inflow section of the incidence side sheet polarizer cooling pipe 4632R are connected, and the outflow section of the incidence side sheet polarizer cooling pipe 4632R and the inflow section of the merging tank 465 are connected. In other words, from the branching tank 464 to the merging tank 465, the emission side sheet polarizer cooling pipe 4633R, the liquid crystal panel cooling pipe 4631R, and the incidence side sheet polarizer cooling pipe 4632R are arranged in series in this order. Similarly, for green light, from the branching tank 464 to the merging tank 465, the emission side sheet polarizer cooling pipe 4633G, the liquid crystal panel cooling pipe 4631G, the incidence side sheet polarizer cooling pipe 4632G are arranged in series in this order. Similarly, for blue light, from the branching tank 464 to the merging tank 465, the emission side sheet polarizer cooling pipe 4633B, the liquid crystal panel cooling pipe 4631B, and the incidence side sheet polarizer cooling pipe 4632B are arranged in series in this order.

A cooling fluid is branched to three channels in the branching tank 464. For each of the colors, first, the cooling fluids flow through the emission side sheet polarizer cooling pipes 4633R, 4633G, and 4633B. Subsequently, the cooling fluids flow through the liquid crystal panel cooling pipes 4631R, 4631G, and 4631B. Finally, the cooling fluids flow through the incidence side sheet polarizer cooling pipes 4632R, 4632G, and 4632B. Since the cooling fluids flow through the respective element cooling pipes along the peripheral edges of the respective elements, the respective elements are cooled and temperature of the cooling fluids flowing through the respective element cooling pipes rises. In this example, since the three element cooling pipes are arranged in series for each of the colors, temperature at the inflow of the cooling fluids (entrance temperature) is the lowest in the emission side sheet polarizer cooling pipes 4633R, 4633G, and 4633B on an upstream side, second lowest in the liquid crystal panel cooling pipes 4631R, 4631G, and 4631B, and relatively high in the incidence side sheet polarizer cooling pipes 4632R, 4632G, and 4632B on a downstream side. Thereafter, the cooling fluids merge in the merging tank 465 and cooled by heat radiation in the radiator 466 (see FIG. 20) explained earlier. The cooling fluid having lowered temperature is supplied to the branching tank 464 again.

In the liquid crystal panels 441R, 441G, and 441B, simultaneously with the light absorption by the liquid crystal layers, a part of light beams are absorbed by the data line and the scanning line formed on the driving substrate and the black matrixes and the like formed on the opposed substrate. In the incidence side sheet polarizer 442, light beams to be made incident are converted into substantially one kind of polarized light by the polarization converting element 414 (see FIG. 18) on the upstream side. Most of the light beams are absorbed and absorption of the light beams is relatively small. In the emission side sheet polarizer 443, a polarizing direction of light beams to be made incident are modulated on the basis of image information. Usually, an amount of absorption of the light beams is larger than that of the incidence side sheet polarizer 442.

An amount of heat generation in the optical device 44 tends to be larger in an order of the incidence side sheet polarizer, the liquid crystal panel, and the emission side sheet polarizer (the incidence side sheet polarizer<the liquid crystal panel<the emission side sheet polarizer).

In the example in FIG. 30, the three element cooling pipes are arranged in series on the channel for a cooling fluid for each of the colors. Thus, a reduction in a piping space is realized compared with the constitution in which all the nine element cooling pipes are arranged in parallel to one another.

Since the cooling fluid is first supplied to the emission side sheet polarizer 443 having a relatively large amount of heat generation, the emission side sheet polarizer 443 is surely cooled.

In the example described above, the element cooling pipes are arranged in series from the upstream side in order from one having a largest amount of heat generation. However, an order of arrangement of the element cooling pipes is not limited to this. The element cooling pipes may be arranged in series from the upstream side in order from one having a smallest amount of heat generation or may be arranged in other orders. An order of arrangement is decided according to a difference of amounts of heat generation among the plural elements, cooling abilities of the element cooling pipes, and the like.

Moreover, all the plural element cooling pipes do not have to be arranged in series for each of the colors. Only a part of the element cooling pipes may be arranged in series as explained below.

Figure 31:
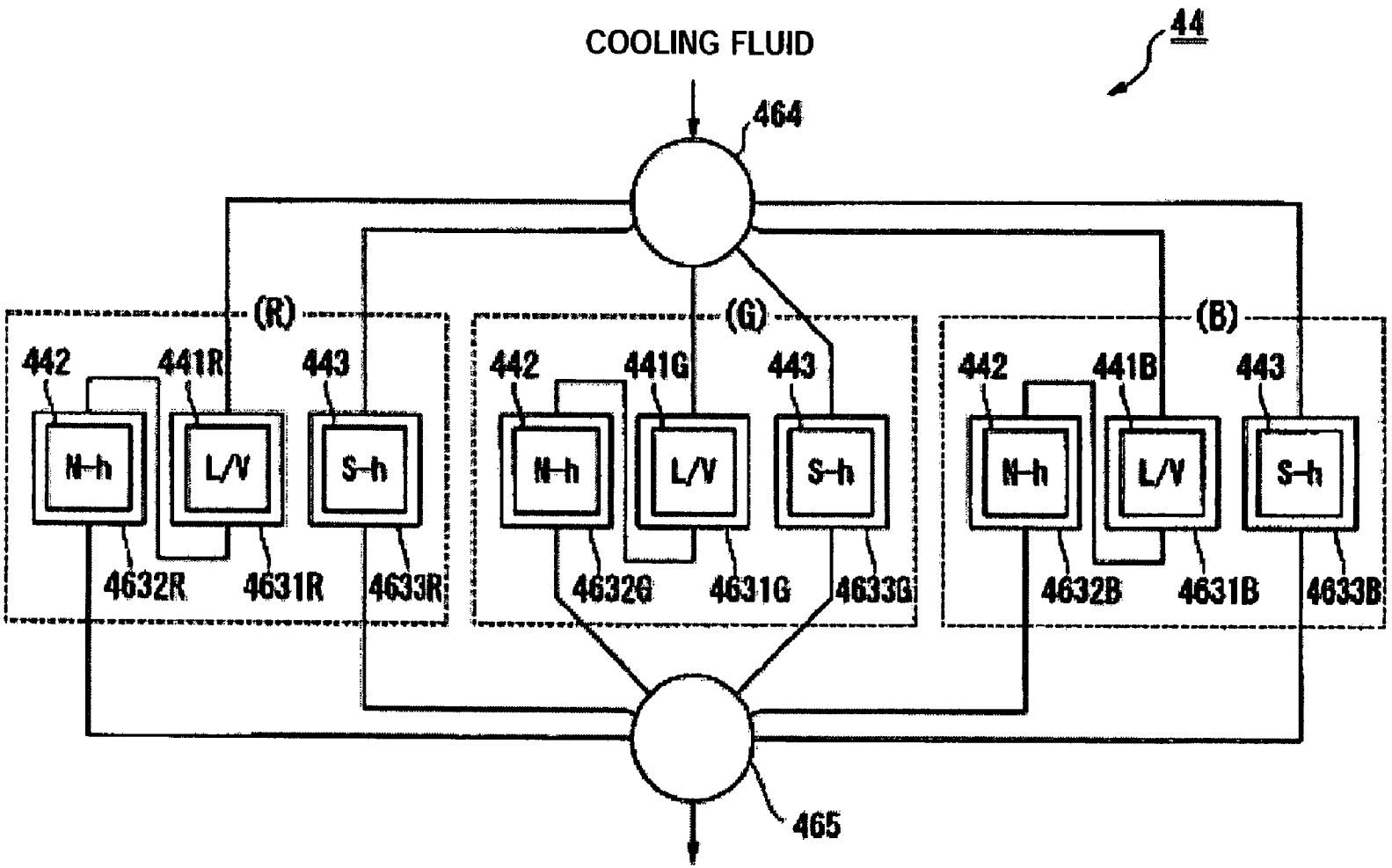
FIG. 31 is a diagram showing another modification of the piping system.

FIG. 31 shows another modification of the piping system. Components same as those in FIG. 29 are denoted by the identical reference numerals and signs.

In an example in FIG. 31, the element cooling pipes (4631R, 4632R, 4633R, 4631G, 4632G, 4633G, 4631B, 4632B, and 4633B) are disposed for the nine optical elements in total including the three liquid crystal panels 441R, 441G, and 441B, the three incidence side sheet polarizers 442, and the three emission side sheet polarizers 443 in the optical device 44. A part of channels for a cooling fluid are provided in series for each of the colors.

Specifically, for red light, from the branching tank 464 to the merging tank 465, the liquid crystal panel cooling pipe 4631R and the incidence side sheet polarizer cooling pipe 4632R are arranged in series in this order. The emission side sheet polarizer cooling pipe 4633R is arranged in parallel to the liquid crystal panel cooling pipe 4631R and the incidence side sheet polarizer cooling pipe 4632R. In other words, the outflow section of the branching tank 464 and the inflow section of the liquid crystal panel cooling pipe 4631R are connected, the outflow section of the liquid crystal panel cooling pipe 4631R and the inflow section of the incidence side sheet polarizer cooling pipe 4632R are connected, and the outflow section of the incidence side sheet polarizer cooling pipe 4632R and the inflow section of the merging tank 465 are connected. The outflow section of the branching tank 464 and the inflow section of the emission side sheet polarizer cooling pipe 4633R are connected and the outflow section of the emission side sheet polarizer cooling pipe 4633R and the inflow section of the merging tank 465 are connected. Similarly, for green light, from the branching tank 464 to the merging tank 465, the liquid crystal panel cooling pipe 4631G and the incidence side sheet polarizer cooling pipe 4632G are arranged in series in this order. The emission side sheet polarizer cooling pipe 4633G is arranged in parallel to the liquid crystal panel cooling pipe 4631G and the incidence side sheet polarizer cooling pipe 4632G. Similarly, for blue light, the liquid crystal panel cooling pipe 4631B and the incidence side sheet polarizer cooling pipe 4632B are arranged in series in this order. The emission side sheet polarizer cooling pipe 4633B are arranged in parallel to the liquid crystal panel cooling pipe 4631B and the incidence side sheet polarizer cooling pipe 4632B.

A cooling fluid is branched to six channels in total, two for each of the colors, in the branching tank 464. First, the cooling fluids flow into the liquid crystal panel cooling pipes

4631R, 4631G, and 4631B and the emission side sheet polarizer cooling pipes 4633R, 4633G, and 4633B for each of the colors. The cooling fluids flowing through the liquid crystal panel cooling pipes 4631R, 4631G, and 4631B flow through the incidence side sheet polarizer cooling pipes 4632R, 4632G, and 4632B and, then, flow to the merging tank 465. On the other hand, the cooling fluids flowing through the emission side sheet polarizer cooling pipes 4633R, 4633G, and 4633B directly flow to the merging tank 465 from the emission side sheet polarizer cooling pipes 4633R, 4633G, and 4633B for each of the colors. Since the cooling fluids flow through the respective element cooling pipes along the peripheral edges of the respective elements, the respective elements are cooled and temperature of the cooling fluids flowing through the respective element cooling pipes rises. In this example, temperature at the inflow of the cooling fluids (entrance temperature) is relatively low in the liquid crystal panel cooling pipes 4631R, 4631G, and 4631B and the emission side sheet polarizer cooling pipes 4633R, 4633G, and 4633B on the upstream side and relatively high in the incidence side sheet polarizer cooling pipes 4632R, 4632G, and 4632B on the downstream side. Since an amount of heat generation of the emission side sheet polarizer 443 is the highest compared with the other elements as described above, temperature at the outflow of the cooling fluids (exit temperature) in the emission side sheet polarizer cooling pipes 4633R, 4633G, and 4633B is relatively high. Compared with this exit temperature, exit temperature of the liquid crystal panel cooling pipes 4631R, 4631G, and 4631B is relatively low. Therefore, in the example in FIG. 31, entrance temperature of the incidence side sheet polarizer cooling pipes 4632R, 4632G, and 4632B is low compared with that in the example in FIG. 30. Thereafter, the cooling fluids flowing at the peripheral edges of the respective elements merge in the merging tank 465 and cooled by heat radiation in the radiator 466 (see FIG. 20) explained earlier. The cooling fluid having lowered temperature is supplied to the branching tank 464 again.

In the example in FIG. 31, the two element cooling pipes are arranged in series for each of the colors and the other one element cooling pipe is arranged in parallel to the two element cooling pipes. Thus, compared with the constitution in which all the nine element cooling pipes are arranged in parallel to one another, a reduction in a piping space is realized.

The cooling channels are provided for the liquid crystal panels 441R, 441G, and 441B and the incidence side sheet polarizer 442 in parallel to the cooling channel for the emission side sheet polarizer 443 having a large amount of heat generation. Thus, a thermal influence of the emission side sheet polarizer 443 is prevented from being exerted on the other elements. The liquid crystal panels 441R, 441G, and 441B and the incidence side sheet polarizer 442 are effectively cooled.

In the examples in FIGS. 29, 30, and 31, the cooling structures for three colors, red (R), green (G), and blue (B), are the same. However, the cooling structures may be different for each of the colors. For example, it is possible that the constitution in FIG. 30 or 31 is adopted for red light and blue light and the constitution in FIG. 29 or 31 is adopted for green light. Further, other combinations of the constitutions may be adopted.

In general, since green light has a relatively high light intensity, temperature of the optical element for green light tends to rise. Therefore, a cooling structure having a high cooling effect is adopted for green light and a cooling structure with a simple constitution is adopted for red light and blue light. Consequently, a reduction in a piping space and efficiency of element cooling are realized.

In the examples in FIGS. 29, 30, and 31, the branching tank 464 branches a channel for a cooling fluid to at least three channels in association with the three colors, red, green, and blue. However, branching of a channel is not limited to this. For example, the branching tank 464 may branch a channel for a cooling fluid to a system for red light and blue light and a system for green light. In this case, for example, cooling structures for red light and blue light are arranged in series and a cooling structure for green light is arranged in parallel to the cooling structures for red light and blue light. Consequently, as described above, it is possible to realize a reduction in a piping space and efficiency of element cooling.

In the embodiment described above, the example of the projector using three liquid crystal panels is explained. However, the invention is also applicable to a projector using only one liquid crystal panel, a projector using only two liquid crystal panels, or a projector using four or more liquid crystal panels.

The liquid crystal panel is not limited to the transmission liquid crystal panel and a reflection liquid crystal panel may be used.

The optical modulator is not limited to the liquid crystal panel. An optical modulator other than liquid crystal such as a device using a micro-mirror may be used. In this case, the sheet polarizers on the light beam incidence side and the light beam emission side do not have to be provided.

The invention is also applicable to a front-type projector that projects an image from a direction for observing a screen and a rear-type projector that projects an image from a side opposite to the direction for observing the screen.

The exemplary embodiments of the invention have been explained with reference to the accompanying drawings. However, it goes without saying that the invention is not limited to such embodiments. It is evident that those skilled in the art can arrive at various modifications and alterations within a range of the technical ideal described in the claims. It is understood that the modifications and the alterations naturally belong to the technical scope of the invention.

The entire disclosure of Japanese Patent Application Nos: 2005-055631, filed Mar. 01, 2005 and 2005-350449, filed Dec. 05, 2005 are expressly incorporated by reference herein.

What is claimed is:

1. A manufacturing method for a cooling unit including a cooling plate in which a cooling fluid flows, the cooling plate having a cooling pipe through which the cooling fluid flows, and a pair of tabular members arranged to be opposed to each other across the cooling pipe, the manufacturing method for the cooling unit comprising:

forming a second tabular member around the cooling pipe according to molding using a material having a low melting point compared with that of the cooling pipe in a state in which the cooling pipe is arranged on a first tabular member of the pair of tabular members.

2. A cooling unit manufactured by the manufacturing method for a cooling unit according to claim 1.

3. A projector comprising:

a light source device;

an optical device including optical modulators that modulate light beams emitted from the light source device according to image information to form an optical image, wherein at least the optical modulators are mounted on a cooling unit that is manufactured by the manufacturing method for a cooling unit according to claim 1; and a projection optical device that magnifies and projects the optical image formed by the optical device.

4. A manufacturing method for a cooling unit including a cooling plate in which a cooling fluid flows, the cooling plate having a cooling pipe through which the cooling fluid flows and a tabular member inside which the cooling pipe is arranged, the manufacturing method for the cooling unit comprising:

forming the tabular member around the cooling pipe according to molding using a material having a low melting point compared with that of the cooling pipe.

5. The manufacturing method for a cooling unit according to claim 4, wherein both the cooling pipe and the tabular member are formed of a metal material.

6. A cooling unit manufactured by the manufacturing method for a cooling unit according to claim 5.

7. A projector comprising:

a light source device;

an optical device including optical modulators that modulate light beams emitted from the light source device according to image information to form an optical image, wherein at least the optical modulators are mounted on a cooling unit that is manufactured by the manufacturing method for a cooling unit according to claim 5; and a projection optical device that magnifies and projects the optical image formed by the optical device.

8. A cooling unit manufactured by the manufacturing method for a cooling unit according to claim 4.

9. A projector comprising:

a light source device;

an optical device including optical modulators that modulate light beams emitted from the light source device according to image information to form an optical image, wherein at least the optical modulators are mounted on a cooling unit that is manufactured by the manufacturing method for a cooling unit according to claim 4; and a projection optical device that magnifies and projects the optical image formed by the optical device.

* * * * *